364-422 SR

6/8/82 OR 4,334,271

United States Patent [19]

Clavier

[11] 4,334,271

[45] Jun. 8, 1982

[54] WELL LOGGING METHOD AND SYSTEM

[75] Inventor: Christian M. Clavier, Paris, France

[73] Assignee: Schlumberger Technology Corporation, New York, N.Y.

[21] Appl. No.: 124,527

[22] Filed: Feb. 25, 1980

[51] Int. Cl.[3] ..... G06F 15/20

[52] U.S. Cl. ..... 364/422; 73/152; 324/323; 324/339

[58] Field of Search ..... 364/422; 324/323, 339, 324/347; 73/152

[56] References Cited

U.S. PATENT DOCUMENTS

| | | | |
|---|---|---|---|
| 3,457,499 | 7/1969 | Tanguy | 324/323 |
| 3,466,532 | 9/1969 | Kolb | 324/323 |
| 3,691,363 | 9/1972 | Armistead | 364/422 X |

*Primary Examiner*—Jerry Smith

*Attorney, Agent, or Firm*—Cooper, Dunham, Clark, Griffin & Moran

[57] ABSTRACT

The disclosed technique finds and shows the attitude of one or more bedding surfaces of an underground earth formation which intersect a borehole in that formation. It starts with a log for each respective path along which a multipath investigating tool takes well logging measurements while being passed through the borehole. A set of a dip and an azimuth signal is produced for each of a number of assumed bedding surfaces which intersect, at a respective number of different attitudes, the same point at the centerline of the tool for a given depth of the tool in the borehole. Portions of the logs for the respective paths chosen by reference to their intersection with each assumed bedding surface are combined so as to get a measure of the mutual degree of fit between the combined log portions. A two-dimensional map is then produced, made up of such measures of fit for the different assumed bedding surfaces at a given depth in the borehole. The map of these measures of fit is used together with other such maps for respective different depths in the borehole, to find, with a high degree of accuracy, the actual attitudes of bedding surfaces which intersect the borehole at respective depths. Various ways are disclosed of refining the maps and making them more accurate, and for forming a tangible record of the results.

21 Claims, 22 Drawing Figures

Fig. 4.
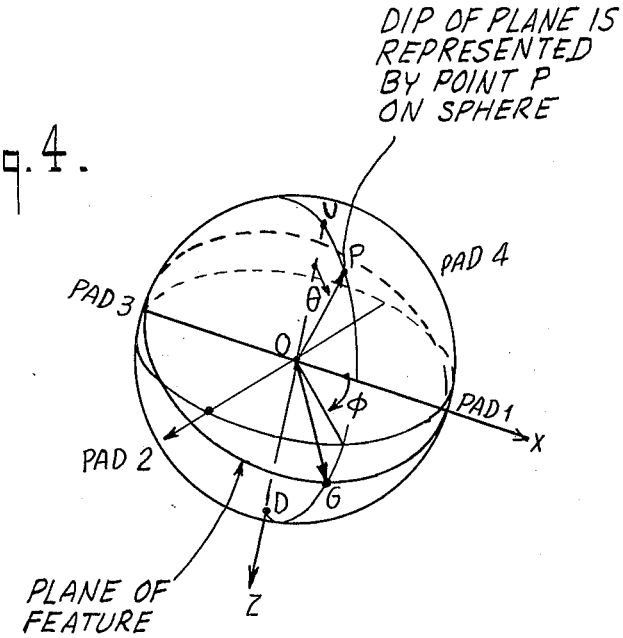
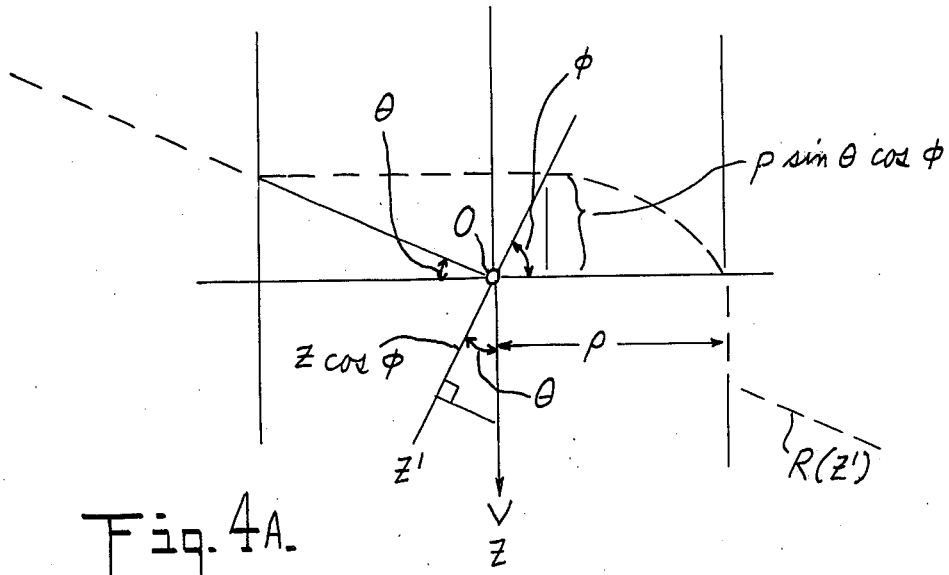
Fig. 4A.

KX24 ↓

| | | | | | | | | | | | | | |
|---|---|---|---|---|---|---|---|---|---|---|---|---|---|
| 6 | 1,1 | | | | | | | | | | | 13,1 | 1 |
| 5 | 1,2 | 805 | | 806 | | 807 | | 808 | | 807 | | 804 | 13,2 | 2 |
| 4 | 1,3 | | | | | | | | | | | | | 3 |
| 3 | | 805 | | 809 | | 810 | | 811 | | 811 | | 807 | | 4 |
| 2 | | | | | | | | | | | | | | 5 |
| 1 | | 802 | | 809 | | 811 | | 813 | | 811 | | 809 | | 6 |
| 0 | | | | | | | 7,7 812 | | | | | | | 7 |
| -1 | | 802 | | 808 | | 811 | | 814 | | 815 | | 811 | | 8 |
| -2 | | | | | | | | | 813 | 813 | 808 | | | 9 |
| -3 | | 798 | | 806 | | 810 | | 814 | 816 | 817 | 812 | 813 | | 10 |
| -4 | | | | | | | | | 811 | 812 | 817 | | 13,11 | 11 |
| -5 | 1,12 | 789 | | 797 | | 803 | | 809 | | 813 | | 811 | 13,12 | 12 |
| -6 | 1,13 | | | | | | | | | | | | 13,13 | 13 |
| | -6 | -5 | -4 | -3 | -2 | -1 | 0 | 1 | 2 | 3 | 4 | 5 | 6 | |
| | 1 | 2 | 3 | 4 | 5 | 6 | 7 | 8 | 9 | 10 | 11 | 12 | 13 | |

KX13 →

WELL LOGGING METHOD AND SYSTEM

DESCRIPTION

BACKGROUND OF THE INVENTION

The invention relates to exploring a subsurface earth formation for valuable underground resources, such as oil and gas, and relates specifically to producing a tangible record, such as a map or a trace, showing the dip and azimuth of bedding surfaces of the earth formation which intersect a borehole which is in that formation. Dip is the angle between the vertical and a vector normal to the bedding surface, and azimuth is the angle between a given direction, say true North, and the projection of the same vector on a horizontal plane.

In well-logging, measurements of various earth formation characteristics are taken by an investigating tool which is passed through a borehole at the end of a supporting cable extending from the surface of the earth. Measurements, which are called samples, are taken at specified intervals by one or more logging devices carried by the tool as the tool is drawn up. Typically, these measurements are of earth formation characteristics such as resistivity, conductance and the like. A set of measurements of the same characteristic is called a log. Such logs are used in various ways to find oil or gas bearing strata. The samples may be recorded directly, or transmitted via a transmission system, into electronic signal processing devices. The recorded or transmitted samples may be processed as digital signals by specially set up general purpose digital computers or, in the alternative, wholly or partly by special purpose signal processing circuitry.

Because of the desirability of finding out more accurately how and at what depth the borehole is intersected by a bedding surface, sophisticated prior art techniques have been used in an effort to find the difference in depth between the places where a feature of a bedding surface intersects the respective paths along the borehole of respective logging devices carried by the tool. These prior art approaches include the use of a process which in effect looks for the degree of similarity of relevant parts of two logs. One example of the techniques used in the prior art is disclosed in application Ser. No. 537,998 filed on Dec. 30, 1974 in the name of C. Clavier, A. Dumestre and V. Hepp and assigned to the assignee of this invention.

Some knowledge about a bedding surface can be found by looking for the degree of similarity between relevant portions of the logs produced by two logging devices moving along a respective first and second path along the borehole. Additional knowledge about the same bedding surface may be found by looking for the degree of similarity between the logs from different pairs of paths along the same borehole. Prior art techniques which employ a process involving the similarity of relevant parts of different pairs of logs in an effort to find the difference in borehole depth between the points of intersection of a feature of a bedding surface with the paths of logging devices moved along the borehole, are proposed in U.S. Pat. Nos. 2,920,306; 2,297,656 and 2,928,071, all issued to Feagin et al. As proposed in these patents, relevant portions of a pair of logs are depth-shifted with respect to each other until they appear to be most similar. Various functions are used to find the relative depth shift of places at which the features of the bedding plane intersect the borehole. These patents are believed to suggest that the relative depth shift between two log portions is independent of other logs and must be determined independently. In U.S. Pat. No. 3,725,981 issued to Sasseen et al, and in an article, "An Electronic Analog Cross Correlator for Dip Logs" by J. H. Sasseen, in the IRE Transactions on Electronic Computers, September 1975, page 182, there are proposals for looking for such similarity of log portions when employing dipmeter tools which produce logs along more than two paths in a borehole. A triple cross-correlator is discussed, and a technique for obtaining the best fit of the relevant log portions is also discussed. A procedure for finding the similarity between the relevant portions of a triple of logs is suggested, although in certain cases more than one answer is obtained for local peaks of apparent similarity. This occasional ambiguity presents a problem in that there is a correct end result only if the arbitrary selection of an initial relative depth shift between two log portions, to serve as an entry point to the procedure, fortuitously turns out to have been correct. No prior art technique is known which can produce a tangible record of the attitude of a bedding surface with the accuracy and efficiency of the invention described below.

SUMMARY OF THE INVENTION

This invention is in the field of well-logging in search for valuable underground resources, and relates specifically to providing a convenient and accurate tangible record of the attitude of a bedding surface of an earth formation which intersect a borehole in the formation.

In one embodiment of the invention, a respective log is produced for each of the respective paths along which respective tool-mounted logging devices move through the borehole in the earth formation. These logging devices may be mounted on the pads of a multipad tool such as a dipmeter. A signal set made up of a dip and an azimuth signal is produced for a given borehole depth for each of a number of assumed bedding surfaces intersecting the borehole at that depth at a respective number of different attitudes. A multiplicity of such signal sets, expressed as pairs of dip and azimuth signals, characterize a respective multiplicity of assumed bedding surfaces. The different assumed bedding surfaces may all be selected to pass through a common locus at the central axis of the tool or of the borehole.

For each assumed bedding surface, the portions of the several logs which are for the places where the respective paths of these logs are intersected by the assumed bedding surface are combined with each other to produce a signal characterizing the degree of fit between the combined log portions. A single such degree-of-fit signal is produced for the mutual degree of fit of the respective portions of at least three of said logs. The degree-of-fit signals are, in turn, used to produce a tangible record of the attitude of a bedding surface of the earth formation which intersects the borehole at the given depth. More specifically, for each of a number of different assumed bedding surfaces intersecting the borehole at a common locus, a two-dimensional map is produced of the respective degree-of-fit signals for the different assumed bedding surfaces for the given depth in the borehole. One of the coordinates of the map is "dip", which may be expressed as the difference in depth between the points where a bedding surface intersects the paths of a first log and the path of a second log, and the other coordinate is "azimuth", which can be expressed as the difference in depth between the points at which an assumed bedding surface intersects the paths of a pair of said logs at least one of which is different from the first and second log.

In fact, the "dip" and "azimuth" coordinates of the map are not true dip (the angle between the vertical and a vector normal to the bedding surface) and true azimuth (the angle between North and the projection of that vector on a horizontal plane), but the map coordinates can be converted to true dip and azimuth based on known geometric relationships and based on the fact that the borehole tool may include a device which outputs, for each set of log samples, a signal indicating the inclination of the tool axis from the vertical and the rotational angle of the tool about its axis relative to North (and, of course, the geometry of the tool and its pads and log measuring devices is known).

A "best" value is then found amongst the degree-of-fit signals making up each such map. The coordinates of this best value show the actual attitude of the bedding surface of the earth formation which may intersect the borehole at that depth. In order to find the sought attitude with greater resolution, for each of said maps the so found best value of a degree-of-fit signal is tested against its neighbors in the same map, and combined therewith to produce a "center of gravity" value which can be considered to be a more accurate measure of bedding surface attitude. Finally, degree-of-fit signals having coordinates about the coordinates of the found best value may be tested for concentricity to determine the planarity or lack thereof of the relevant bedding surface.

In an alternate embodiment of the subject invention the process is similar to the point of deriving a respective degree-of-fit signal for each of the assumed bedding surfaces which intersect the borehole at a common locus at a given depth. A first two-dimensional map, formed in equiangular steps of dip and azimuth values, is tested to find the best degree-of-fit signal contained in it. The coordinates of the so found best value of this first map is a coarse indication of the actual attitude of a bedding surface. A second two-dimensional map having finer steps than the first map is superimposed on the first map at a region thereof containing the best value previously found. A best value is then found among the degree-of-fit signals contained in the second, finer map. The coordinates of this best value are a finer indication of the sought actual attitude of a bedding surface.

The above is repeated for other given borehole depths to produce other such maps of degree-of-fit signals. The maps for the successive borehole depths may be combined to provide signals indicating detected trends of actual attitudes of bedding surfaces in the earth formation.

More specifically, in practicing one embodiment of the invention, the analog signal responses for each of the paths of the multipad investigating tool, such as a dipmeter tool, are converted to digital samples. A respective set of samples, called a log, is derived for the path of each respective logging device carried by a pad of the investigating tool, with each sample of a given log being a measure of a respective given earth formation characteristic which is related to a given depth in the well and to a point on the path of the device producing that sample. As the dipmeter tool passes through the borehole, a correlation depth typically measured at the central axis of the tool is selected. The point at the central axis of the tool which is at the selected correlation depth can be thought of as a common locus or a pivot point through which a number of different assumed bedding surfaces pass. Each assumed bedding surface is initially presumed to be planar. This assumption of a planar surface simplifies the invented system and yet, as explained below, still provides results which indicate whether the relevant bedding surfaces are non-planar.

Samples, one each, from the logs obtained from an investigating tool having at least three but typically more well logging paths define an assumed planar bedding surface passing through the central axis of the tool at the selected correlation depth. The samples obtained at any two paths spaced diametrically opposite across the borehole may be viewed as corresponding to the ends of a diagonal intersecting the selected common locus in the assumed planar surface. It should be apparent that any selected assumed bedding surface can be identified by the locus depth, dip and azimuth.

As a way to visualize the many assumed bedding surfaces which intersect each other at the common locus on the tool axis at a given depth in the borehole, one may think of an assumed bedding surface which is pivoted at that common locus and is nutated about that locus so that the points where the assumed bedding surface intersects paths which are diagonally opposite each other across the borehole, move in opposite axial directions. In the course of this nutation, the diagonals connecting diametrically opposite samples always pass through the common locus which is at the selected correlation depth. This nutation process may be continued until the assumed bedding surface has come to an attitude at which it is normal to the axis of the tool at the selected correlation depth. The choice of a common locus at the central axis of the borehole tool, and the movement along diagonally opposite samples in opposite directions helps reduce the undesirable effect of what is known in the art as the "end effect" problem. For each assumed bedding surface, a degree-of-fit signal is found using a respective correlation length from each of the three or more logs produced by the multipath borehole tool for the respective three or more paths along which log measurements are taken in the borehole. Each such degree-of-fit signal is a measure of the mutual degree of fit between the respective three or more logs at the respective places where their paths are intersected by the respective assumed bedding surface. The so found degree-of-fit signals may be stored in the memory circuit of a computer in a location therein identifiable in accordance with a two-dimensional coordinate system. The two-dimensional coordinate system forms a grid of "dip" vs. "azimuth" cells. Since a given "dip" and "azimuth" can be represented by the location in the borehole of two diagonals intersecting at a common locus (at the centerline of the tool), the horizontal axis of this coordinate system can be thought of as corresponding to difference in borehole depth between respective samples of a first pair of logs produced from diagonally spaced paths along the borehole, and the vertical axis can be thought of as corresponding to the difference in borehole depth between respective samples of a second pair of such logs. The horizontal axis of this coordinate system has a central zero point which corresponds to zero differences in depth as between respective diagonally spaced samples of the first pair of logs. Similarly the vertical axis has a centrally located zero point corresponding to zero difference in depth as between respective diagonally spaced samples of the second pair of logs. Each marking away from the zero points on the respective axis means that the respective two diagonally spaced samples intersected by a given assumed bedding surface differ from each other in borehole depth by a certain amount of depth or, stated differently, the two relevant samples are vertically spaced from the common locus by the same distance in opposite directions.

Each so found degree-of-fit signal is stored in the memory circuit of the computer corresponding to a location (or cell) in the map. Respective cells of the map are filled in for respective different assumed planar bedding surfaces intersecting the borehole. When all the cells, or grid elements, in the map have been filled in, the result is a two-dimensional map of degree-of-fit signals which are all for assumed bedding surfaces passing through the common locus which is at the centerline of the tool and is at a particular correlation depth in the borehole.

After all the grid elements have been filled in, a test is made to locate the best degree-of-fit signal in the map. In this embodiment and at this stage in the process, the highest value in the grid or map may be selected as the "best" one. The coordinates of the highest value degree-of-fit signal in the map give the actual attitude of a bedding surface of the earth formation which may intersect the borehole at the depth of the particular common locus corresponding to that map. After the degree-of-fit signal having the highest value has been so located, it is tested against other degree-of-fit signals having coordinates adjacent thereto. If, in fact the degree-of-fit signal having the highest value has neighbors also having relatively high values, it is confirmed that the coordinates of the highest value found are an indication of the actual attitude (dip and azimuth) of a bedding surface and not merely of a spurious high value. For a planar bedding surface, the degree-of-fit signal having the highest value should be surrounded by concentric circular contours of other relatively high values of degree-of-fit signals. For a nonplanar bedding surface, there should be non-circular such contours of relatively high values. A major and minor axis of the non-circular contours may be used to find the kind of nonplanarity of the found bedding surface. Once the horizontal and vertical coordinates have been found of the degree-of-fit signal having the highest value in the two-dimensional map, the depth, and true dip and true azimuth of the corresponding bedding surface can be found based on known geometric relationships.

In a preferred embodiment of the invention, the process of finding given degree-of-fit signals involves a test of the degree of similarity between the respective relevant samples of the three or more logs used in producing that degree of fit signal and the average value of the relevant log samples. When the absolute value of a specified combination of these individual samples and this average value gets closest to a specified level, so-called "best similarity" is reached. It is noted that if the degree-of-fit signals are initially found by testing relevant log sample combinations in equal steps of depth in the borehole, and then directly transformed to angular coordinates as a function of dip and azimuth, there would be a sampling distortion which would be most evident at extreme attitudes. In order to avoid such distortion, a grid (or map) is used which is made up of cells distributed uniformly over a hemisphere rather than a plane. The equidistant cells on the hemisphere correspond to assumed bedding surfaces which are in uniform steps of dip and azimuth angles, i.e., in equiangular steps of dip and azimuth.

The coordinates of the best degree-of-fit signal found through use of this hemispherical map or grid are, in the general case, only an approximation of the best value which could be found had the map or grid been to a finer resolution. However, the use of a coarser map or grid initially helps minimize the number of evaluations required to form it, while at the same time giving an approximate indication of the actual attitude of a bedding surface. In order to make this initial approximation more accurate, without at the same time having to construct the entire hemispherical map to a finer resolution, a second map, having a finer resolution is formed, but only for a small region of the initial, coarse map or grid. The center of the second, finer map is at the coordinates of the best degree-of-fit signal found with the help of the initial, coarse map, and the finer map extends around this center for only a limited distance, so as to avoid making evaluations for indications already provided by the first, coarse map. A limited number of degree-of-fit signals in cells of the finer map are tested against each other to find a second initial indication of the coordinates of the best degree-of-fit signal. Then the eight surrounding neighbors thereof are evaluated to see if this newly found best degree-of-fit signal is at the center of the surrounding cells. If so, this is a confirmation that it is associated with the actual attitude of a bedding surface. Furthermore, a center-of-gravity determination may be made centered at the coordinates of the best degree-of-fit signal found with the help of the finer map and its neighbors so as to get a still better approximation of the actual attitude of a bedding surface. The dip, azimuth and depth describing the relevant bedding surface, and perhaps maps that have been formed in the process, may be displayed at this time. The entire process may be repeated for other depths in the borehole, and maps for successive depths may be combined to provide indications of detected trends of bedding surfaces. The found dip and azimuth may be displayed in terms of the map coordinates or, more typically, they are used to form a tangible record of at least true dip and true azimuth.

BRIEF DESCRIPTION OF THE DRAWINGS

FIG. 4 shows the bedding surface illustrated in FIG. 3 duplicated as a circle on a unit sphere;

FIG. 4*a* illustrates a schematic diagram of a bedding surface in terms of angular relation with respect to the borehole;

DETAILED DESCRIPTION

Figure 1:
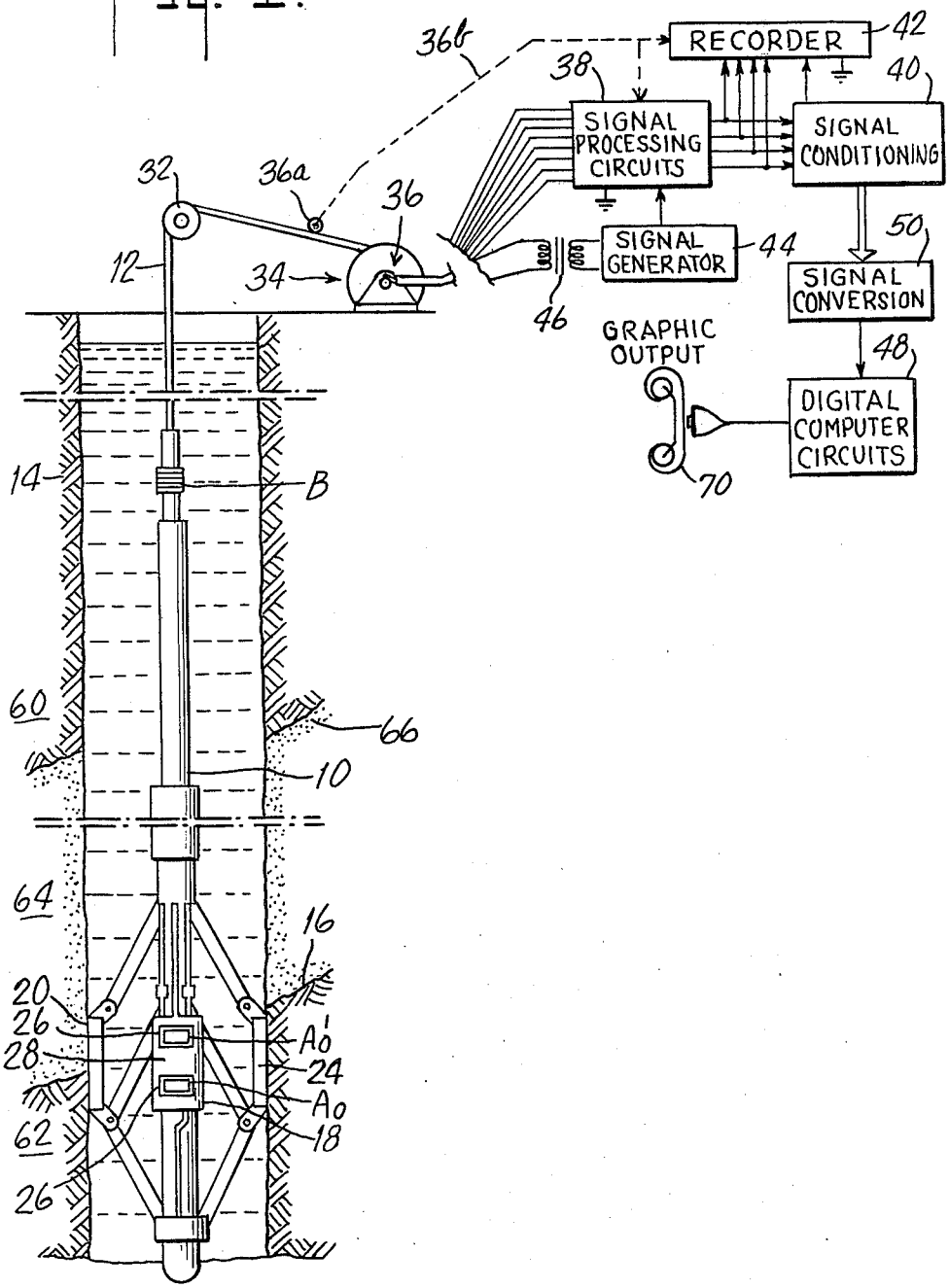
FIG. 1 illustrates an investigating tool in a borehole and apparatus at the surface of the earth for controlling the investigating tool, for recording the measurements produced by it and for processing these measurements and for producing a record of the attitude of bedding surfaces in a subsurface earth formation.

Referring to FIG. 1, a multipad investigating tool 10, which may be the tool commonly referred to as a dipmeter, is lowered on an armored multiconductor cable 12 into a borehole 14 to investigate a subsurface earth formation 16. The tool 10 is adapted for movement up and down the borehole 14 and may include four pads 18, 20, 22 and 24 (the front pad 18 obscures the view of the back pad 22 which is not shown). The pads 18, 20, 22 and 24 are uniformly angularly spaced from each other along the circumference of the borehole 14. Each pad carries one or two (or more) logging devices each adapted to derive measurements, comprising sets of samples, or logs, at the wall of the borehole 14. The pads 18, 20, 22 and 24 may each carry, for example, a survey electrode designated as $A_o$, and one of the pads, for example, in this instance pad 18, may carry an additional survey electrode $A'_o$, useful in determining the speed of the tool 10. Each survey electrode $A_o$ is surrounded by an insulating material 26. The insulating material 26 and the survey electrode $A_o$ are further surrounded by a main metal portion 28 of the pad. The metal portion 28 of each pad, along with certain other parts of the tool may comprise a focusing system for confining the survey current emitted from each of the different survey electrodes into the desired focus pattern. Survey signals representative of changes in the earth formation characteristic along a path in the borehole opposite the path inscribed by the movement of the respective electrode are produced from circuits comprising the $A_o$ electrodes, focusing elements, and current return electrode B. In addition, the tool may contain devices (such as a magnetic compass and a device for detecting the tool inclination from the vertical, which devices are not shown) to provide signals from which the attitude of the tool itself can be found each time the devices on its pads take log samples. A detailed description of a multipad (and therefore multipath) investigating tool is disclosed in U.S. Pat. No. 3,521,154 issued to J. J. Maricelli on July 21, 1970 and entitled, "Methods and Apparatus for Enhancing Well Logging Signals by the Use of Multiple Measurements of the Same Formation Characteristic".

The upper end of the multipad investigating tool 10, as shown in FIG. 1, is connected by means of the armored multiconductor cable 12 to suitable apparatus at the surface of the borehole 14 for raising and lowering the tool 10 therethrough. Mechanical and electrical control of the tool 10 may be accomplished with the cable 12 which passes from the tool 10, up through the borehole 14 to a sheave wheel 32 at the surface and then to a suitable drum and winch mechanism 34.

Electrical connections between various conductors of the cable 12, which are connected to the previously described electrodes, and various electrical circuits at the surface of the earth are accomplished by means of a suitable multi-element slip ring and brush contact assembly 36. In this manner the signals which originate from the tool 10 are supplied to signal processing circuits 38, which in turn supply the signals to a signal conditioner 40 and a recorder 42. A suitable signal generator 44 supplies current to the tool 10 via a transformer 46 and, as may be needed, to the various signal processing circuits at the surface. Further details of such circuits are described in the aforementioned Maricelli patent.

The log signals from the investigating tool 10 may be recorded graphically by a film recorder 42. One such recorder is disclosed in U.S. Pat. No. 3,453,530 issued to G. E. Attali on July 1, 1969, and entitled, "Methods and Apparatus for Investigating Earth Formation Including Measuring the Resistivity of Radically Different Formation Zones". In addition, the log signals may be processed to obtain discrete samples and recorded on digital tape. A suitable digital tape recorder is described in U.S. Pat. No. 3,648,278 issued to G. K. Miller et al on Mar. 7, 1972, and entitled, "Methods and Apparatus for Use in Processing Well Logging Data".

The signals derived from each electrode of the tool 10 may be sampled by driving sampling devices, such as those in the digital tape recorder, by sampling signals based on the motion of the cable 12 as measured at the surface. For example, a cable length measuring wheel 36*a* shown in FIG. 1 may be used in timing of the signal processing circuits 38 and the sampling and recording cycling as indicated by a sampling signal line 36*b*. Each log sample thus corresponds to a measurement taken at a given depth in the borehole, and this depth can be found, e.g., by knowing the depth of a given log sample, the depth interval between samples and the order of the sample of interest in the set of samples which make up the log.

The log samples may be transmitted directly or indirectly to computer circuits which may be located at the well site or may be transmitted via a transmission system to computer circuits at a remote location. One transmission system which may be used is disclosed in U.S. Pat. No. 3,599,156 issued to G. K. Miller, et al., on Aug. 10, 1971, entitled, "Methods and Apparatus for Transmitting Data Between Remote Locations".

The recorded or transmitted log samples (and any other tool output) may be processed as digital signals by a general purpose digital computer conditioned, as by programming, to carry out the process described herein, or by a special purpose computer apparatus composed of circuits and/or modules built and arranged especially for the purpose of carrying out the described steps of the same process.

Alternatively, as shown in FIG. 1, the signals may be processed directly at the well site, using digital computer circuits 48 interfaced to a signal conversion means 50. One example of such computing apparatus is the system PDP-11/45 made by Digital Equipment Corp. and specially modified, as by stored program instructions, to carry out the steps of the invented process.

Suppliers of such equipment may also supply conditioning circuits 40 and signal conversion means 50 suitable for conditioning and converting analog signals to digital samples for subsequent digital storage and processing. Further, the computing apparatus includes memory circuits for storing log samples (and any other relevant tool output) and intermediate and final results of signal processing, as well as signals related to various parameters, coefficients and controls used and generated in the processing steps.

As the tool 10 goes through the well 14 it passes through different subsurface earth formations. Typical formations are represented, for example, by earth formations 60 and 62 shown in FIG. 1, and intervening sand formation 64. Typical earth formation features are boundaries 16 and 66 shown between these formations.

Thus, in review, for each path measured by the tool 10 there is produced a set of samples, each sample being a measure of an earth formation characteristic at a given depth and for a given path in the well 14. A set of such samples for a given path constitutes one log. Four logs are obtained from the particular investigating tool 10, illustrated here.

Figure 2:
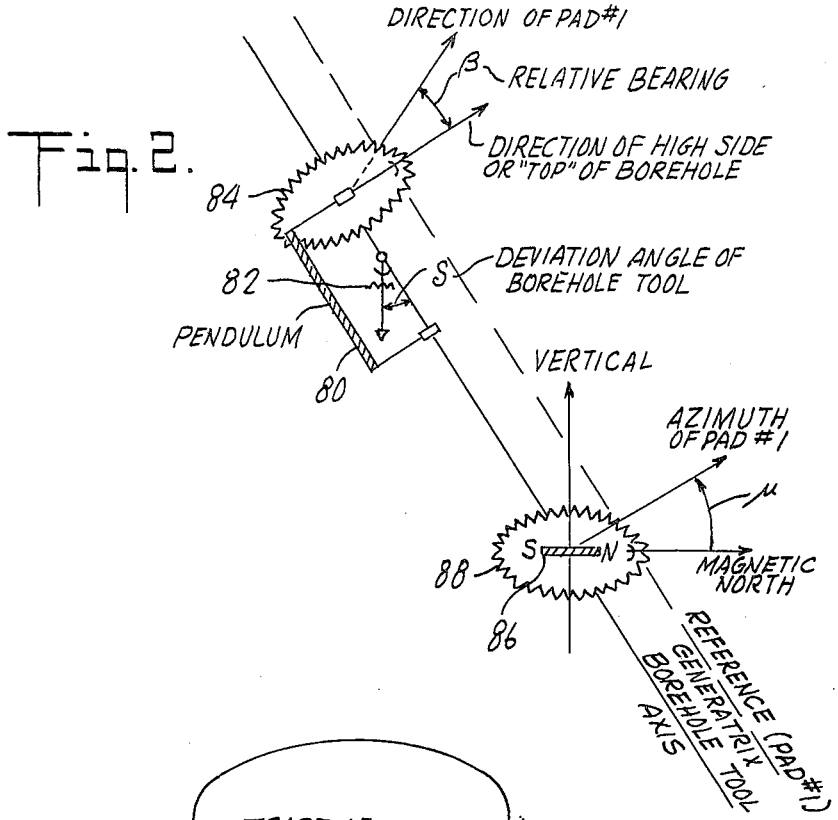
FIG. 2 illustrates an inclinometer system for referencing information characterizing a portion of the investigating tool of FIG. 1.

Referring now to FIG. 2, a brief description will be given of how certain reference information is produced for the purpose of characterizing the position of the multipath investigating tool 10, and consequently the sources of the signals. Incorporated within the tool 10 shown in FIG. 1 is an inclinometer system, schematically illustrated in FIG. 2. The inclinometer system is referenced to one of the signal sources, usually on the pad designated as number 1, in this case, pad 18. The inclinometer system is composed of two related measuring systems. One system contains a pendulum 80 suspended in relation to the centerline or axis of the tool 10 such that it establishes a vertical plane in which to measure the deviation angle $\delta$ of the tool 10. This may be accomplished, for example by measuring, with a second pendulum and a potentiometer 82, the angular deviation of the tool axis from the vertical pendulum. This deviation is sometimes referred to as the drift angle. The first pendulum 80 is also related in a rotational sense to the position of the reference pad. An additional potentiometer 84 may be used to measure the rotational angle $\beta$ between the reference pad and pendulum 80 position. This angle is conventionally measured from the high side or the top of the borehole and is commonly referred to as the relative bearing. It is conventional to measure this angle such that it has a positive sign when measured clockwise from the high side of the hole to pad 1.

An additional system incorporated within the tool 10 includes a magnetic compass 86 and another potentiometer 88 such that the potentiometer measurement reflects the angle by which the referenced pad differs from magnetic North as measured by the compass 86. As further shown in FIG. 2, this angle $\mu$ corresponds to the azimuth of the number 1 pad. Thus, it may be seen how the position of a reference point on the tool 10, i.e., pad 18, may be related both to magnetic North, as expressed by the azimuth, and to the top of the hole as expressed by its relative bearing and deviation angle.

It should be apparent that any measurement which is referenced to the position of the pad 18, may also be referenced to the top of the borehole 14 or magnetic North which, of course, may be converted to geographic North. Still further, it will be apparent how the position of the top of the borehole and magnetic North may be referenced to pad 18. It is well known how to use these reference measurements. Further details may be obtained, for example, in a paper, "Automatic Computation of Dipmeter Logs Digitally Recorded on Magnetic Tape" by J. H. Moran et al, in the *Journal of Petroleum Technology,* July, 1962, particularly in the appendix thereof.

Figure 3:
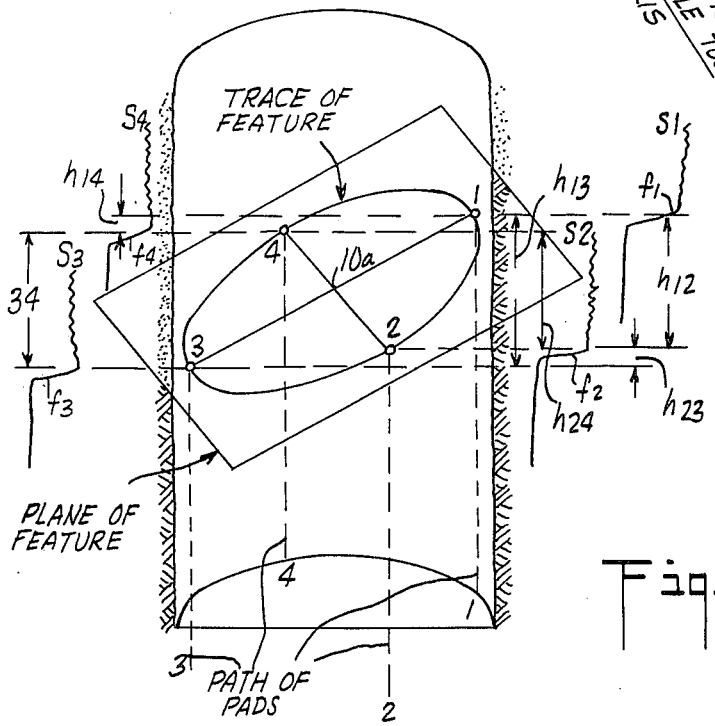
FIG. 3 illustrates an example of a portion of logs derived at respective paths along the borehole, and a planar bedding surface intersecting the borehole.

Referring now to FIG. 3, there are illustrated the four pads 18, 20, 22 and 24 of the dipmeter 10 shown in FIG. 1. The pads 18, 20, 22 and 24 are designated here as pads 1, 2, 3 and 4. As the dipmeter 10 goes through the well 14, log measuring devices $A_o$, one on each pad, trace respective paths along the wall of the borehole as indicated by the dash vertical lines in FIG. 3. These paths intersect an earth formation characteristic, indicative of a bedding surface, at the borehole wall at the four points indicated by small circles, 1 through 4. The nature of the pad suspension system for the dipmeter assures that these paths are on opposite sides of the borehole well for four alternate, circumferentially spaced pads, i.e., pads 1 and 3 and pads 2 and 4 are on opposite sides of the borehole 14 relative to the tool axis, which is at 10*a*.

The log signal response for the four paths, one per pad, is shown in FIG. 3 as S1 through S4. The change in the character of the log signals, corresponding to the earth formation characteristic relative to the bedding surface which intersects the borehole 14, is shown as signal features $f_1$ through $f_4$. When the bedding surface of the feature is so inclined relative to the borehole 14, there will be a difference in depth (in the borehole) between the corresponding features of each log signal. As shown in FIG. 3, one path will respond to the feature first, with the opposite path responding last as the tool 10 traverses the borehole. Specifically in this instance, these paths correspond to pads 3 and 1 respectively.

It is known that the difference in borehole depth between the points of intersection of the feature with the path of the logs along the wall of the borehole 14 may be determined by use of a process which measures the similarity of two signals. For example, the degree of similarity between log samples S1 with S2 can furnish the depth difference $h_{12}$, between points $f_1$ and $f_2$. As illustrated in FIG. 3, path 2 intersects the feature plane at a greater depth than path 1. Thus, the depth of point $f_1$ on signal S1 is less than the depth of point $f_2$ on signal S2. By convention, the depth difference $h_{12}$, between the points of intersection in S1 and S2, is therefore, considered to be negative. This is consistent with the notation that the depth difference between two signal features equals the depth of the feature on the signal from the first path minus the depth of the feature on the signal from the second path.

Additional depth differences along the borehole 14, similar to the differences determined between points $f_1$ and $f_2$ corresponding to the adjacent paths 1 and 2, may be found for the four-arm tool 10 by comparing the respective degrees of similarity of adjacent signals S2 with S3, S3 with S4 and S4 with S1. Two additional depth differences may be obtained to complete a full round of depth displacements in the illustrated case by correlating log signals S1 with S3 and S2 with S4, obtained from the diagonally opposing paths. Thus it can be seen that the difference in depth in the borehole 14 between the points of intersection of the feature with the paths of the logs taken along the borehole 14 may be determined by use of a process which measures the similarity of pairs of log signals.

It is also known that the positions of any three points define the position of a plane, and that the position of a planar bedding surface may be expressed in the dipmeter art as the depth, dip and azimuth of the plane. Referring to FIG. 4, the bedding surface described in FIG. 3 is duplicated as a circle on a unit sphere with its center at 0. This circle is identified by a vector OP perpendicular to the bedding plane circle. If the sphere is considered to be of unit radius, vector OP is called the unit dip vector. The line connecting the log measuring devices of pads 1 and 3 is the x-axis of a coordinate system having its origin at 0, the line connecting the log measuring devices at pads 2 and 4 is the y-axis, and the axis of tool 10 is the z-axis. The angular distance from point U on the upper half of the unit sphere at the Oz-axis to point P is the apparent dip magnitude, $\theta$ (often called simply apparent dip, or dip) and the angular distance counted clockwise, from the meridian plane containing coordinate axis Oz and Ox, to the meridian plane containing axis Oz and vector OP, is the apparent dip azimuth, $\phi$ (often called simply apparent azimuth, or azimuth). Thus, the location of point P fully defines the orientation of the illustrated bedding surface. Note that the vectors are projected relative to the position of the pads in the electrode plane (i.e., the plane of devices $A_o$) of the tool 10. The diagonal 1–3 forms the x-axis and the diagonal 2–4 forms the y-axis, thus defining an equatorial electrode plane. The axis of the tool 10 forms the z-axis. Point P could be referred to in geographic coordinates, as already described, by locating on the sphere its intercepts with the true vertical axis and the North vector.

If both $\theta$ and $\phi$ of a bedding surface are equal to zero, i.e., the bedding surface is at the electrode plane of the tool 10, the point representing the corresponding dip falls at the zenith of the unit hemisphere, i.e., point U. A point P corresponding to a bedding surface which is nearly parallel to the tool axis falls near the unit sphere's equator, corresponding to an apparent dip magnitude which approaches 90°.

The various apparent "dips" at various depths in the borehole, as defined by various $\theta$ and $\phi$ pairs, may be plotted as points on the upper hemisphere of the sphere in FIG. 4. These points usually do not fall at the same place on the sphere—if they do, the measured attitudes of bedding surfaces are in perfect coherence.

Figure 5:
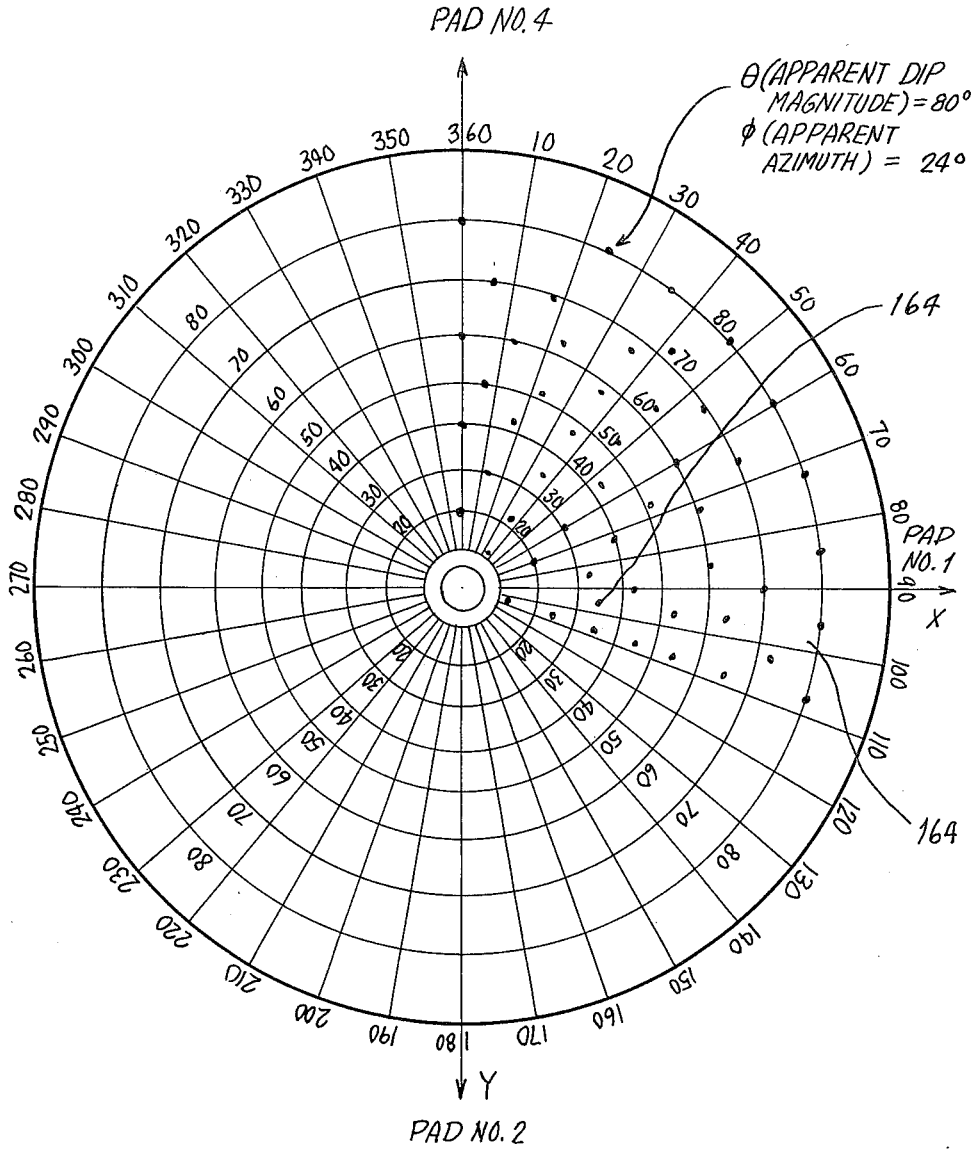
FIG. 5 shows a planar map projection of the hemispherical surface illustrated in FIG. 4.

While the dips can be plotted on the surface of the upper hemisphere of the sphere of FIG. 4, for convenience, it is more practical to represent the hemispherical surface by an equivalent planar map, sometimes referred to as the "Schmidt Equal Area Map", illustrated in FIG. 5. The numbered concentric circles in FIG. 5 represent coordinates of apparent dip magnitude $\theta$, and the numbered radii represent coordinates of apparent azimuth $\phi$. The Ox-axis is again in the direction to path 1, and Oy-axis is in the direction to path 2. The plane of the paper represents the plane of the electrodes.

A feature of the Schmidt mapping scheme is that it conserves area, in that any two areas on the hemisphere of FIG. 4 that are equal are represented by two areas on the Schmidt map in FIG. 5 that are also equal.

With regard to the subject invention and referring to FIG. 4*a*, if at a selected depth, z, in the borehole, the resistivity, R, measured around the given wall of the borehole 14 is uniform in bedding surfaces normal to an axis z', the resistivity variation along the axis z' may be expressed as:

$$R(z')=R(z\cos\theta+\rho\sin\theta\cos(\phi'-\phi)) \quad \text{(Eq. 1)}$$

where $\rho$ is the radius of borehole 14, z, $\theta$, and $\phi$ are the depth at point O, apparent dip and azimuth of the plane respectively, and $\phi'$ is a selected angle about the axis of the borehole 14.

If two arbitrary values are selected for $\phi'$, e.g., $\phi_1$ and $\phi_2$ pointing, respectively to the places where the resistivity, R, is measured, along two respective paths, these two values, $\phi_1$ and $\phi_2$ can be used in accordance with expression 1 to find the depth difference between the intersections of a bedding plane and the paths defined by $\phi_1$ and $\phi_2$. This partially positions the bedding surface. For example, referring back to FIG. 3, if the depth difference, $h_{12}$, between the signal feature $f_1$ on S1 and the signal feature $f_2$ on S2 is desired, said features having corresponding apparent azimuth angles, $\phi_1$ and $\phi_2$, respectively, $h_{12}$ is given by:

$$R((z+h_{12})\cos\theta+\rho\sin\theta\cos(\phi_2-\phi))=R(z\cos\theta+\rho\sin\theta\cos(\phi_1-\phi)) \quad \text{(Eq. 2)}$$

Other depth differences $h_{13}$, $h_{24}$, etc. may be found in a similar manner, and the points where a bedding surface intersects the relevant paths may be found similarly. More specifically, with regard to expression 1, where $h_{12}$ was found, one may proceed by using a test function, $T(\tau_{12})$, of the form:

$$T(\tau_{12})=[R((z+\tau_{12})\cos\theta+\rho\sin\theta\cos(\phi_2-\phi))-R(z\cos\theta+\rho\sin\theta\cos(\phi_1-\phi))]^2 \quad \text{(Eq. 3)}$$

The function $T(\tau_{12})$ is evaluated for a variety of test values, denoted as $\tau_{12}$, and averaged over an interval of the borehole 14. The value which minimizes the function, $\langle T(\tau_{12})\rangle$, is called $h_{12}$. The value, $h_{12}$, partially positions the bedding surface, and one can continue for combinations of the other signals, i.e., $\tau_{13}$, $\tau_{14}$, etc. More generally, $\tau_{ij}$ is determined by $\theta^*$ and $\phi^*$ according to:

$$(z+\tau_{ij})\cos\theta^*+\rho\sin\theta^*\cos(\phi o_j-\phi^*)=z\cos\theta^*+\rho\sin\theta^*\cos(\phi_i-\phi^*) \quad \text{(Eq. 4)}$$

or $$\tau_{ij}=\rho\tan\theta\,[\cos(\phi_j-\phi)-\cos(\phi_i-\phi)] \quad \text{(Eq. 5)}$$

Stated differently, for any given $\theta^*$ and $\phi^*$ (which are trial dip and azimuth values defining a selected point on the unit hemisphere) and any given $\phi_i$, $\phi_{i+1}$, $\phi_{i+2}$, . . . , $\phi_j$ (the azimuth of respective paths), $\tau_{ij}$ gives the points where the bedding surface intersects the paths i and j. If $\rho$, the radius of the borehole 14, at a given depth varies, this can be compensated for by finding $\tau_{ij}$ where a variable $\rho$ is taken into account, from the following:

$$\tau_{ij}=\tan\theta^*[\rho_j\cos(\phi_j-\phi^*)-\rho_i\cos(\phi_i-\phi^*)] \quad \text{(Eq. 6)}$$

It can be appreciated that the test function used has been a function of two sets of signals only. Other test functions exist and may be used in this procedure, but again such test functions are functions of two sets of signals only.

It has been discovered, as part of the subject invention, that the invented process may use a composite test function utilizing portions of all the log signals simultaneously, i.e., simultaneously using portions of the logs corresponding to paths 1, 2, 3 and 4, may be advantageous. Moreover, instead of considering the test function dependent on, or as a function of, depth displacement, the test function is evaluated as a function of $\theta^*$ and $\phi^*$, which are trial dip and azimuth values.

In the four-path investigating tool 10 six nonredundant possibilities for $\tau$ exist, namely $\tau_{12}$, $\tau_{13}$, $\tau_{14}$, $\tau_{34}$, $\tau_{24}$, $\tau_{23}$. These are all determined simultaneously by an operation described in principle by equation 5 once $\theta^*$ and $\phi^*$ are specified. After $\tau$ is determined a test function, $T(\theta^*, \phi^*)$, which uses portions of the logs obtained from paths 1, 2, 3 and 4 of the dipmeter 10 may be represented in the following form:

$$\sum_{i=1}^{i=n-1} \sum_{j=i}^{j=n} [R(z + \tau_{ij}, \theta, \phi_i) - R(z, \theta, \phi_j)]^2 \quad \text{(Eq. 7)}$$

where n=4 for this particular dipmeter 10 and i and j represent specific pads.

Since bedding surfaces usually have thicknesses corresponding to several samples, a given depth interval is used which is consistent with the thickness of the bedding surface of interest—short intervals (3 feet or less) for stratigraphic bedding planes and long intervals (tens of feet) for structural bedding features. Thus, an average of the test function $T(\theta^*, \phi^*)$ over the bedding surfaces may be obtained. The results of the averaging are tested to find a minimum value, $<T(\theta^*, \phi^*)>$, and the corresponding $\theta^*$ and $\phi^*$ values, to obtain the actual position of a bedding surface of the earth formation. It should be noted that these values may very well differ from the value of $\theta$ and $\phi$, the apparent dip and azimuth, arrived at by prior art methods.

Some difficulties may arise in practicing this procedure. Arbitrary choices of assumed $\theta^*$ and $\phi^*$ values do not usually yield $\tau_{ij}$ values that are compatible with the sampling interval chosen for analysis. The depth distance between samples obtained from the analog logging signals is fixed by the sampling interval chosen when these signals are converted to digital samples by signal conversion means 50. The assumed bedding surface, however, must pass through at least three, if not preferably four, samples in order that $T(\theta^*, \phi^*)$ can be evaluated conveniently. While it is possible to use neighboring values of $\tau_{ij}$ at the adjacent sampling intervals, and averaging them to obtain a value at the required point, this proves complicated in practice and detracts from the otherwise simple, but powerful invented process and apparatus for carrying it out.

In review, it can be seen that one aspect of the invention disclosed here relates to generating a log for the path, along the borehole 14 through the earth formation, of each of the pads of the dipmeter 10 passed through the borehole 14. A dip signal $\theta^*$ and an azimuth signal $\phi^*$ is produced for each of a number of assumed bedding surfaces intersecting the borehole 14 at respective different attitudes and intersecting each other at a common locus on the tool axis at a given borehole depth. For each assumed bedding surface the portions of the logs for the respective paths at the intersection with the assumed bedding surface are combined to form a signal $T(\theta^*, \phi^*)$ characterizing the degree of fit between the combined log portions. These degree-of-fit signals may be utilized to drive a device for providing a visual indication of actual attitude of a bedding surface of the earth formation which intersects the borehole at that depth.

Figure 6:
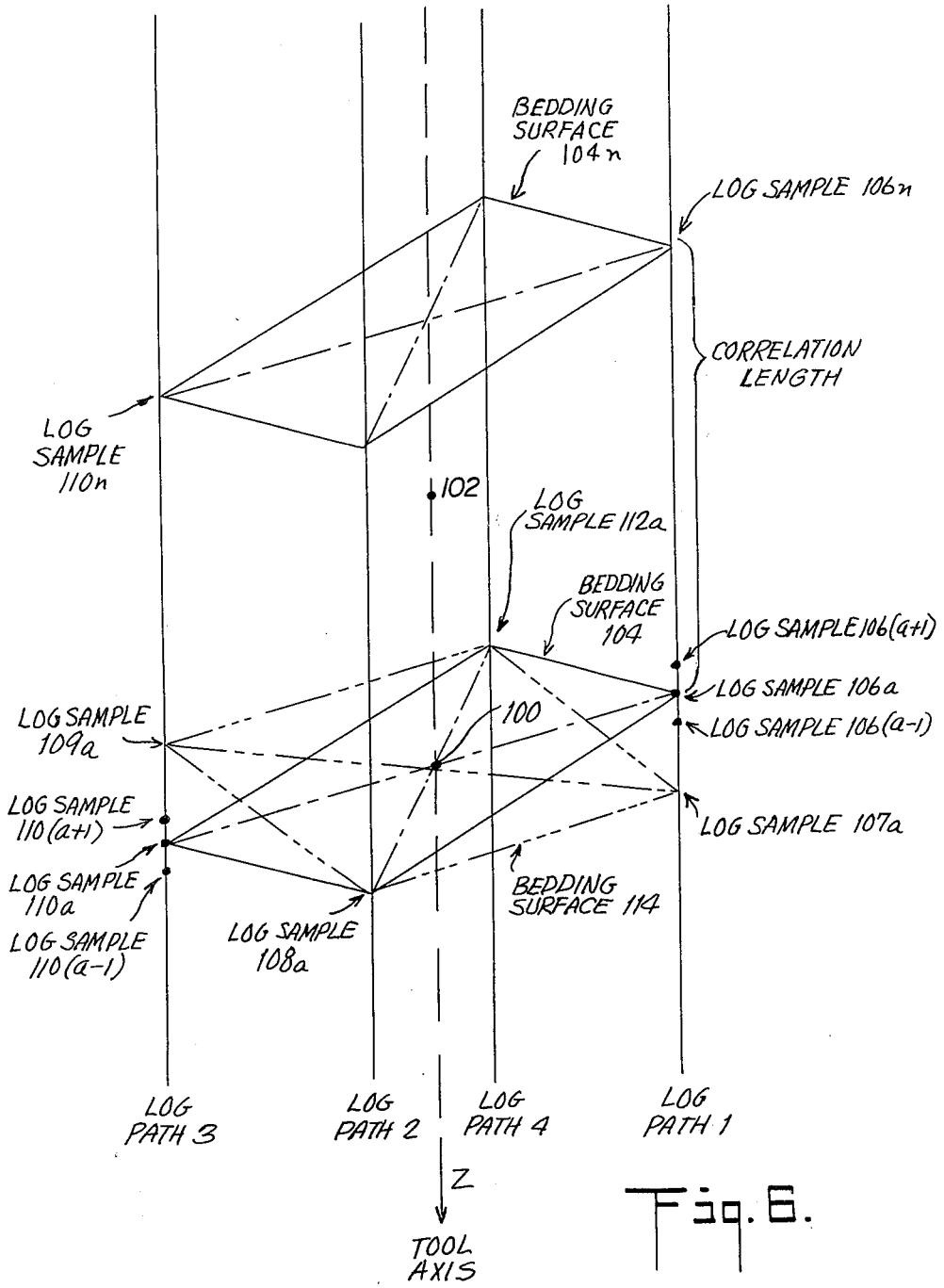
FIG. 6 illustrates the relative positions of several log samples produced by the investigating tool.

In a more specific embodiment of the invention, the analog signal responses for the path of each of the pads, 1, 2, 3 and 4 of the dipmeter 10 are converted to digital signal samples by the signal conversion means 50 as illustrated in FIG. 1. A set of samples is derived for each path of the investigating tool 10, with each sample being a measure of an earth formation characteristic at a given depth in the borehole 14. Each set of samples comprises one log and thus four logs, one each from pads 1, 2, 3 and 4 are obtained. Referring to FIG. 6, a schematic diagram of samples obtained from the four-arm dipmeter 10 is illustrated to assist in understanding this embodiment of the subject invention. As the dipmeter 10 passes through the borehole 14, a correlation depth 100 measured at the central axis of the tool 10 is initially selected. A correlation depth 102, also measured at the central axis of the tool 10 is next selected as the dipmeter 10 moves up the borehole 14. The depth displacement between correlation depths 100 and 102 comprises a correlation step which is defined as the depth difference between successive depths at which correlation processes are carried out. By convention, as already discussed herein, the difference between depth 100 and depth 102 is therefore considered to be positive. The correlation step is selected by a user of the invented system. As an example, the system may provide for a maximum correlation step of 10 feet (equal to the correlation length, which is the length of one log which is compared with an equal length of another log in the correlation process). The minimum correlation step may be 1 foot, and the user may select intermediate values in 1-foot increments. If the user makes no selection, the system provides a default value of 2 feet.

Stratigraphic and structural analyses of the earth formation characteristics generally require different types of logging. In stratigraphic analysis, an attempt is made to have dipmeter signals represent bedding surfaces within the boundaries at a given geological unit, i.e., dips of layers of generally similar material. These bedding surfaces have little, if any, regional extent. In structural analysis, i.e., analogs of dips of interfaces between different materials, a deliberate attempt may be made to mask out such sedimentary features in favor of enhancing the boundaries of the individual strata. Accordingly, short lengths (1 to 2 or 3 feet) of dipmeter signals are typically correlated to obtain stratigraphic information while long lengths (10 to 20 or 30 feet) of signals are typically correlated to obtain structural information. While use of long correlation lengths to obtain structural dip has been the practice for some time, there are certain disadvantages associated with this practice. One is that the use of long correlation lengths mask dip patterns needed for stratigraphic analysis. Thus, additional findings must be made using a short length to obtain stratigraphic information. Another is that most long correlation length techniques may be influenced by frequently occurring stratigraphic features having a common dip and direction, even though each such feature is less pronounced than the structural feature. Thus, the use of long correlation lengths does not assure obtaining actual structural dip information. While short correlation lengths have recently been used to obtain stratigraphic information (for example, see the aforementioned Clavier et al application), it has been discovered in this invention that there are certain advantages in using shorter correlation lengths where the correlation is a function of a portion of the logs from at least three pads of the tool 10 to obtain perhaps different and more detailed information is determining the attitudes and the shapes of bedding surfaces, including nonplanar surfaces, from a plurality of assumed planar bedding surfaces. Moreover, the invented system allows a user to select the correlation parameters depending on whether stratigraphic information is desired, in which case short lengths of logs are correlated, or structural information is desired, in which case longer lengths of logs are correlated.

The correlation depth 100 at the central axis of the tool 10 in the borehole 14 can be thought of as a common locus or a pivot point through which a number of different assumed bedding surfaces pass. Each assumed bedding surface is initially presumed to be planar. While the surfaces of many geological formations may not in fact be planar, the assumption of a planar surface greatly simplifies the invented system as compared with the prior art, yet still provides results which indicate whether the bedding surface is in fact nonplanar. Two tests, the closure and planarity tests, are used in the art to determine whether a true bedding surface has been located. The closure test is a practice in surveying and simply requires, as indicated by its name, that a given traverse along a surface must close. In this case this requirement means that the sum of all differences in depth between the intersection points of a surface and the four log paths when one starts with a given pad and returns to that pad must equal zero. With reference to FIG. 3 this requirement may be expressed as:

$$h_{12}+h_{23}+h_{34}+h_{41}=0 \qquad \text{(Eq. 8)}$$

When the sum does not equal zero, this sum is usually termed the closure error and is indicative that two different features were reflected in the correlation. The planarity test is that opposing displacements between two orthogonal diameters should be equal and opposite. When such a term is not equal to zero it may be regarded as a planarity error. With reference to FIG. 3, this requirement may be expressed as:

$$h_{12}+h_{34}=h_{23}+h_{41} \qquad \text{(Eq. 9)}$$

The planarity and closure tests discussed here are more fully detailed in the aforementioned Clavier et al application. By assuming a planar surface and not having to resolve problems in the correlation process caused by surfaces having closure or planarity incoherence as in the prior art, the invented system avoids serious complexity yet still provides results which indicate whether the bedding surfaces found have nonplanarity characteristics.

Referring to FIG. 6, it can be seen that four samples, one each from the logs from paths 1, 2, 3 and 4 can define an assumed planar bedding surface 104 passing through the central axis of the tool 10 at a correlation depth 100. The intersection points of this assumed bedding surface 104 with the four log paths are at log samples 106*a*, 108*a*, 110*a* and 112*a*. The diagonals connecting diametrically opposite intersection points of this bedding surface 104 intersect at the common locus 100. Another, and different bedding surface 114 is also illustrated. It shares with the surface 104 the intersection points 108*a* and 112*a* but its two other intersection points are different, namely they are intersection points at log samples 107*a* and 109*a*. One way to visualize the difference between these two bedding surfaces is to think of rotating bedding surface 104 about diagonal 108*a*–112*a*. Since the surfaces 104 and 114 have a common diagonal, they of course coincide at the common locus 100. Additional different bedding surfaces may be visualized as resulting from rotating the bedding surface 104 about the diagonal 106*a*–110*a*. Such additional bedding surfaces will again have a common diagonal with the surface 104 and will therefore coincide with each other and with the surface 104 at the common locus 100. As mentioned earlier, the choice of a common locus at the central axis of the tool 10 helps reduce undesirable influences due to the "end effect" problem. To appreciate this "end effect" problem, consider that a correlation length of log 1, i.e. the illustrated portion of log 1 from log sample 106*a* through log sample 106*n* is to be compared for correlation purposes with an equal length of the log from path 3 at various relative displacements between the two log portions, for example by comparing the illustrated correlation length of log 1 first with the portion of the log for path 3 from log sample 110*a* through log sample 110*n*, then with the portion from log sample 110 (a+1) through log sample 110 (n+1), then with the portion from log sample 110 (a+2) through log sample 110 (n+2), etc. Since the correlation length of the log from path 1 is fixed in this correlation process, if there happens to be an abrupt change in log value at about the ends of the correlation length of log 1 a large and perhaps erroneous influence may effect such a correlation process. However, if as in this invention correlation is carried out not by using any fixed correlation length for any one log but by using each time a correlation length which differs by at least two log samples from the previously used correlation length, such undesirable influences are avoided or at least minimized. As a simplified example of the use of this concept of the invention, the correlation length of log 1 from log sample 106*a* through log sample 106*n* would be compared for correlation purposes with the correlation length of log 3 from log sample 110*a* through 110*n*, then the correlation length from log sample 106 (a+1) through 106 (n+1) would be compared with the correlation length from log sample 110 (a−1) through 110 (n−1) and so on, and then the correlation length from sample 106 (a−1) through 106 (n−1) would be compared with the correlation length from 110 (a+1) through 110 (n+1) and so on, as explained in detail below. If this is done for all four of the log paths the process may be visualized as nutating an assumed bedding plane about the common locus 100 and checking, for each selected new attitude of the bedding surface, the degree of fit between the four log portions relevant to the bedding plane when in that selected attitude. The best degree of fit corresponds to a given attitude of the assumed bedding surface. However, since the correlation length extends over many log samples a best degree of fit relates not only to the specific assumed bedding plane which passes through the common locus 100 but also to all assumed bedding planes parallel to it which intersect the correlation lengths used in deriving the particular best degree of fit. In the example illustrated in FIG. 6, if the assumed bedding surface 104 gives the best degree of fit in the correlation process, this applies not only to the bedding surface 104 but also to the bedding surface 104*n* and to all assumed bedding surfaces which are parallel to the surfaces 104 and 104*n* and are between them.

Referring again to the aspect of the invention related to minimizing undesirable influences of the "end effect", it should be appreciated that the fact that the borehole may be out-of-round at certain places does not affect the accuracy of the process since the pad suspension mechanism in one form of the tool 10 generally assures that opposite paths are equally displaced from the tool centerline and the radial distance from the tool centerline and the pad-mounted logging devices is directly obtainable from caliper measurements by the tool 10 and the geometry of the tool.

Figure 7:
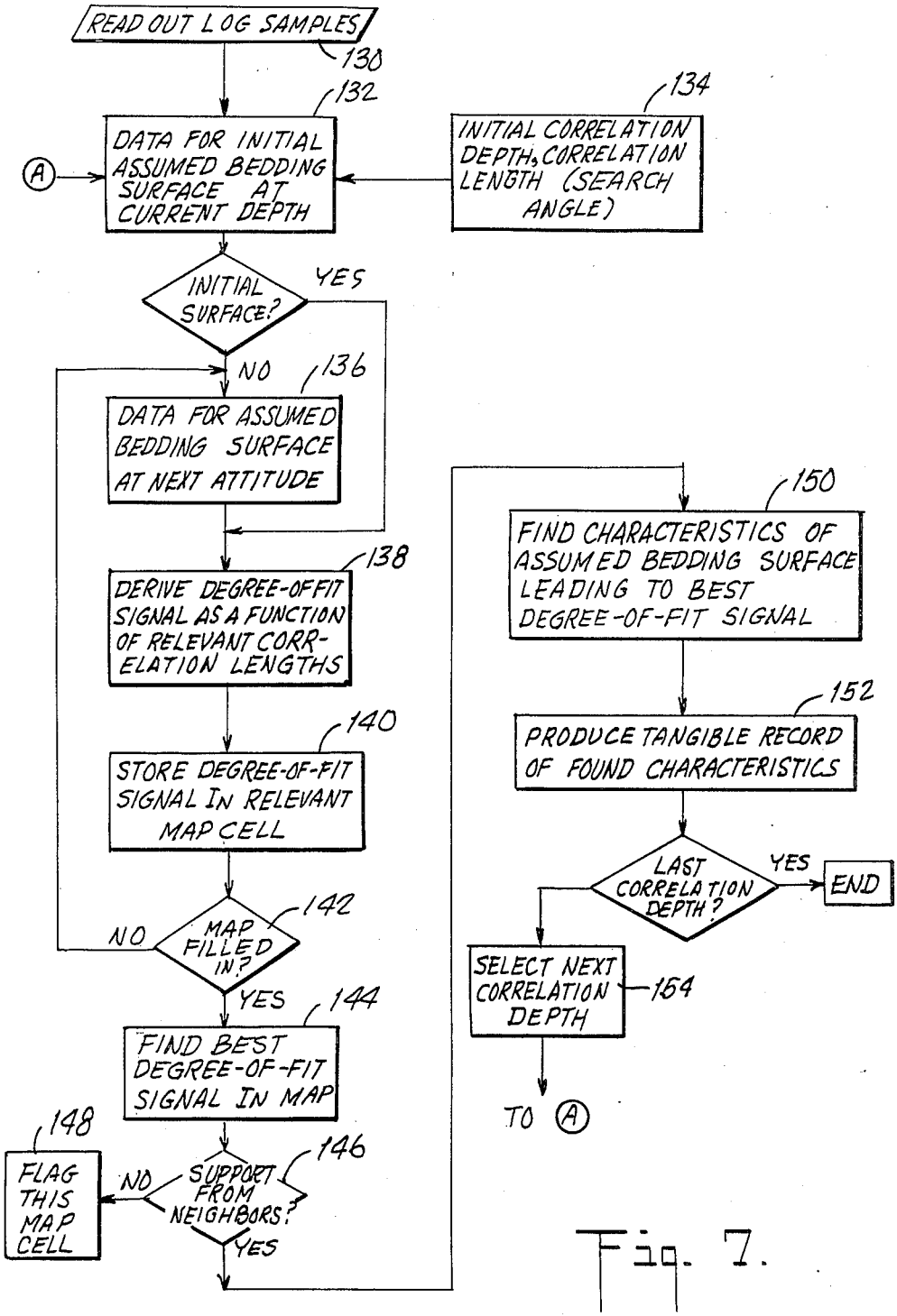
FIG. 7 is a generalized flow chart aiding in the description of one embodiment of the invention.

Referring in greater detail to one embodiment of the invention, the main functional steps are as follows. After the signals obtained from paths 1, 2, 3 and 4 of the four-arm investigating tool 10 are converted to sets of digital samples, or logs, by signal conversion means 50, as illustrated in FIG. 1, the logs, one log per path, may be stored on tape or may be directly stored in the memory of the computer 48. Referring to FIG. 7, the stored samples, at step 130, may be then read out from either the tape or the memory. At step 132 four sample values, one per log, are selected to define an assumed bedding surface passing through a selected correlation depth at the central axis of the tool 10. As already described with reference to FIG. 6, samples obtained from alternate angularly spaced pads of the dipmeter 10 correspond to the ends of diagonals in the assumed planar surface. The diagonals intersect at a common locus at the chosen correlation depth, and the points at which they intersect the relevant log paths define, in effect, the dip and azimuth of an initial assumed bedding surface.

Figure 8:
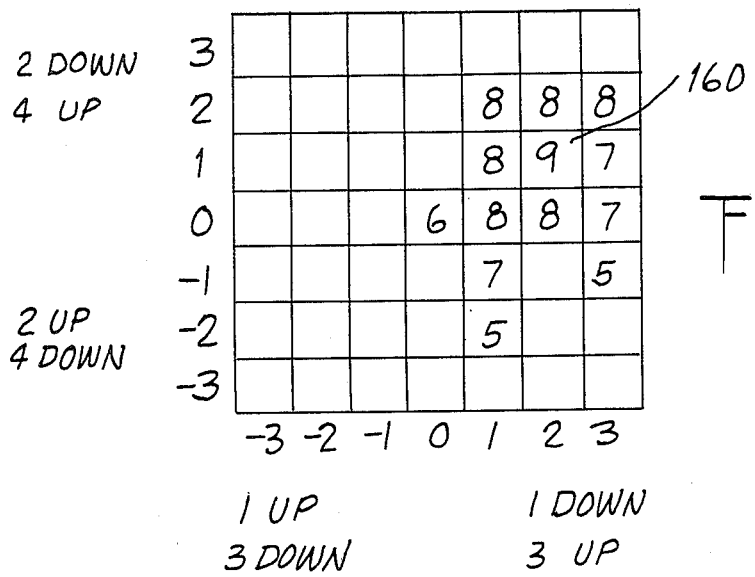
FIG. 8 illustrates a portion of a two-dimensional map of degree-of-fit signals for several assumed bedding surfaces which intersect the centerline of the tool at the same locus.

Values for a selected correlation length, correlation step, initial correlation depth (to the extent not already defined by the initial log samples read at 130) and perhaps correlation search angle may be supplied at step 134. The search angle is the angle at a given correlation depth, at the tool axis, between the assumed bedding surface which has the greatest inclination relative to the tool axis in one direction and the assumed bedding surface which has the greatest inclination in the opposite direction. Once the specific initial assumed bedding surface has been defined at 132 in terms of its borehole depth and attitude, step 136 is skipped in this case and the process proceeds to step 138, where the log samples read out at 130 and the correlation parameters read out at 134 are used to derive a degree-of-fit signal as a function of the relevant correlation lengths of the relevant logs. The so derived degree-of-fit signal is stored at step 140 in a two-dimensional map arbitrarily defined in computer memory, at the coordinates thereof which correspond to the intersection points of the initial assumed bedding surface and the paths of the four logs. An exemplary part of such a map is illustrated at FIG. 8. This map has a horizontal axis with markings which in effect indicates the inclinations of assumed bedding planes all of which have the same intersection points on the paths of logs 2 and 4, and has a vertical axis with markings which in effect indicate the inclinations of assumed bedding planes all of which have the same intersection points on the paths of logs 1 and 3.

The result of a first pass through step 140 in FIG. 7 is a degree-of-fit signal which goes into a particular cell or grid element of the FIG. 8 map. For example, if the initial assumed bedding surface happens to be perpendicular to the tool axis at the selected initial correlation depth, the degree-of-fit signal goes into the cell of the map of FIG. 8 which has coordinates 0, 0. As an example a degree-of-fit signal having a value of six is illustrated as stored in that cell having coordinates 0, 0. In view of the fact that the correlation length emcompasses a number of log samples, the term "initial assumed bedding surface" encompasses not only what can be termed a "reference" initial bedding surface, i.e. the bedding surface passing through the tool axis at the initial correlation depth but also all other assumed bedding surfaces parallel to that reference surface which intersect the respective paths of the four logs within the relevant correlation lengths thereof. In order to make the description hereafter less cumbersome only the term "assumed bedding surface" will be used from now on with the understanding that it would include the entire set just defined of the "reference" assumed bedding surface and the bedding surfaces which are parallel to it and are within the respective correlation lengths.

At step 142 in FIG. 7 a test is made to find out if the map is filled in, i.e. to find out if all of the map cells or grid elements already have respective degree-of-fit signals stored in them. If the answer is no, the process returns to step 136 where the appropriate attitude parameters are updated to define an assumed bedding plane which passes through the same initial correlation depth but has a different attitude such that the new assumed bedding surface can be visualized as resulting from pivoting the previous one by a certain angle and in a certain direction on the point of the tool axis which is at the correlation depth. Steps 138 and 140 are then repeated for the new assumed bedding surface to derive a new degree-of-fit signal which goes into the respective cell of the map. When all of the cells of the map are filled in, the answer at step 142 is yes. As mentioned earlier FIG. 8 illustrates only a portion of the relevant map. The entire relevant map has many more cells and the cells provided for in the map are used in effect at step 142 to determine the maximum permissible inclinations between the assumed reference surfaces and the tool axis.

When the answer at step 142 is yes, the process continues to step 144 to find the map coordinates of the best degree-of-fit signals stored in that map. One examplary definition of a "best" degree-of-fit signal is that having the highest value, e.g. the signal 9 stored at cell 160 at xy coordinates 2, 1 in FIG. 8. In the specific example of FIG. 8, the best degree-of-fit signal has an x coordinate of 2, meaning that the corresponding assumed bedding surface intersects the path of log 1 two increments down from the correlation depth and intersects the path of log 3 two increments up from the correlation depth. The fact that the best degree-of-fit signal has an y coordinate of 1 means that the corresponding assumed bedding surface intersects the path of log 2 one increment down from the correlation depth and intersects the path of log 4 one increment up from the correlation depth. The term increment is used in this context to refer to depth difference between two adjacent intersection points on the same log path. This may be selected to be one sample interval, in case higher resolution is desired, or it may be selected to be several sample intervals, in case it is desired to reduce somewhat the processing effort.

Returning to FIG. 7, once the best degree-of-fit signal has been located at step 144 of the process, a test is made at step 146 to find out if that degree-of-fit signal has adequate support from its neighbors. One way of finding this out is to compare the value of the best degree-of-fit signal with the values of its immediate neighbors on all sides. In the example illustrated in FIG. 8, the eight immediate neighbors all have high values, which indicates the likelihood that the degree-of-fit signal in map cell 160 is not a spurious one. This particular comparison may be a type of a threshold comparison, e.g. an effort to see if there is a value difference greater than a certain percentage between the best degree-of-fit signal and the average value of its eight immediate neighbors. If the test at step 146 shows that the found best degree-of-fit signal is not supported adequately by its neighbors, this seemingly spurious degree-of-fit signal is flagged at step 148 as a possible error. The flagged map cell may be simply disregarded in further processing or an effort may be made, through the use of a finer map as described below, to see if any further use may be made of it.

Once the process finds at step 146 that the particular best degree-of-fit signal found at step 44 has adequate support from its neighbors, it continues to step 150 to find more about the corresponding bedding surface. For example the process may examine the contours of iso-values of degree-of-fit signals which surround the best degree-of-fit signal. The term iso-values is used in this context to refer to values of degree-of-fit signals which differ from each other by less than a certain percentage of their average value or by less than a certain fixed amount. This examination of contours is based on the realization that the best degree-of-fitness signal for a planar bedding surface should be surrounded by concentric and circular contours while the best degree-of-fitness signal for a nonplanar assumed bedding surface should be surrounded by distorted contours where the distortion may be an indication of the type of nonplanarity. For example, a trough-shaped bedding surface may be surrounded by concentric eliptical contours where the shape of the contours may be an indication of the curvature of the trough and the orientation of the contours may be an indication of the direction of the trough. Following this, the process produces at step 152 a tangible record of whatever characteristics it has found of the assumed bedding surface of interest. This tangible record may be, as explained below, of a new type not used and not possible prior to this invention. Following the production of a tangible record of the bedding surface found in step 152, the process proceeds to step 154 where the next correlation depth is selected and then returns to step 130, to read the log samples for the various correlation lengths that may be relevant to the new correlation depth. The tangible record at the end of the process may include an indication of the borehole depth and attitude of the assumed bedding surfaces which have the best degree-of-fit signals, which attitudes may be expressed in terms of the depth differences between the points of intersection of the respective assumed bedding surfaces with the log paths, and/or the apparent dip and azimuth of the surfaces (derived by suitably transforming the depth of the points of intersection) and/or true depth and azimuth (derived again by suitably transforming the depths of the points of intersection based on known relationships). The particular form the tangible record may take is discussed in connection with the more detailed description of particular embodiments below.

As mentioned earlier, the map an example of which is shown at FIG. 8 contains a type of a sampling distortion because the angles between adjacent assumed bedding surfaces represented by adjacent cells surround the periphy of the map can be considerably smaller than the angles between adjacent assumed bedding surfaces represented by adjacent cells near the center (the 0, 0 coordinates) of the map. Stated differently, the uniform divisions along the x and y axis of the map of FIG. 8 do not correspond to equiangular steps of apparent dip and azimuth or of true dip and azimuth. Instead, as one moves away from the origin of the map illustrated at FIG. 8 the uniform divisions correspond to smaller and smaller steps in dip and azimuth angle. It has been realized in accordance with this invention that it is desirable to have a map of best degree-of-fit signals which is in equiangular steps of dip and azimuth, which may be apparent dip magnitude and apparent azimuth or may be true dip magnitude and true dip azimuth, so as to arrive at a more accurate and more representative indication of not only the attitude of an assumed bedding surface but also of the shape of nonplanar assumed bedding surfaces. Accordingly, this invention uses a process in which the degree-of-fit signals are found for assumed bedding surfaces which can be identified with respective uniformly distributed areas or points on the hemisphere illustrated in FIG. 4. A known way to divide the surface of a hemisphere into small triangles is to use what is known as a counting net as discussed in Structural Geology by D. M. Ragan at pages 112 et seq. In this known technique the surface of the hemisphere is divided into small triangles six of which form a hexagonal area equal to, for example, one percent of the total area. In the process of this invention, however, a uniform distribution over the hemisphere surface, in terms of equiangular steps of apparent dip and azimuth in degrees, is found in accordance with a Table I below, where the values of apparent azimuth are listed in the left-hand column, in degrees, and one or more values of apparent dip, in degrees, are listed in the columns to the right of that. Each combination of an azimuth value and one of the dip values in the same line gives the coordinates on the hemisphere of FIG. 4, with the resulting areas on the hemisphere being distributed such that a step from any one of these areas to an adjacent one corresponds to the same attitude angle between two adjacent assumed bedding planes. Stated differently, when a map is constructed for the apparent dip and azimuth values specified by Table 1 below, this map is for a number of assumed bedding surfaces all of which intersect each other at a point on the tool axis at a given correlation depth in the borehole and which differ from each other in attitude in uniform angular steps of attitude. The values in Table I are in degrees of azimuth angle and dip angle.

TABLE I

| Azimuth | Dip | | | | | | |
|---|---|---|---|---|---|---|---|
| 0 | 0 | 20 | 40 | 60 | 80 | | |
| 6 | 70 | | | | | | |
| 7.5 | 50 | | | | | | |
| 12 | 31 | 80 | | | | | |
| 13 | 60 | | | | | | |
| 18 | 42 | 70 | | | | | |
| 22 | 51 | | | | | | |
| 24 | 62 | 80 | | | | | |
| 30 | 72 | | | | | | |
| 36 | 11 | 22 | 33 | 44 | 54 | 64 | 80 |
| 42 | 72 | | | | | | |
| 48 | 62 | 80 | | | | | |
| 50 | 51 | | | | | | |
| 54 | 42 | 70 | | | | | |
| 54 | 60 | | | | | | |
| 60 | 31 | 80 | | | | | |
| 64.5 | 50 | | | | | | |
| 66 | 70 | | | | | | |
| 72 | 20 | 40 | 60 | 80 | | | |
| 78 | 70 | | | | | | |
| 79.5 | 50 | | | | | | |
| 84 | 31 | 80 | | | | | |
| 85 | 60 | | | | | | |
| 90 | 42 | 70 | | | | | |
| 94 | 51 | | | | | | |
| 96 | 62 | 80 | | | | | |
| 102 | 72 | | | | | | |

TABLE I-continued

| Azimuth | Dip | | | | | | |
|---|---|---|---|---|---|---|---|
| 108 | 11 | 22 | 33 | 44 | 54 | 64 | 80 |
| 114 | 72 | | | | | | |
| 120 | 62 | 80 | | | | | |
| 122 | 51 | | | | | | |
| 126 | 42 | 70 | | | | | |
| 131 | 60 | | | | | | |
| 132 | 31 | 80 | | | | | |
| 136.5 | 50 | | | | | | |
| 138 | 70 | | | | | | |
| 144 | 20 | 40 | 60 | 80 | | | |
| 150 | 70 | | | | | | |
| 152.5 | 51 | | | | | | |
| 156 | 31 | 80 | | | | | |
| 157 | 60 | | | | | | |
| 162 | 42 | 70 | | | | | |
| 166 | 51 | | | | | | |
| 168 | 62 | 80 | | | | | |
| 174 | 72 | | | | | | |
| 180 | 11 | 22 | 33 | 44 | 54 | 64 | 80 |
| 186 | 72 | | | | | | |
| 192 | 62 | 80 | | | | | |
| 194 | 51 | | | | | | |
| 198 | 42 | 70 | | | | | |
| 203 | 60 | | | | | | |
| 204 | 31 | 80 | | | | | |
| 207.5 | 51 | | | | | | |
| 210 | 70 | | | | | | |
| 216 | 20 | 40 | 60 | 80 | | | |
| 222 | 70 | | | | | | |
| 223.5 | 50 | | | | | | |
| 228 | 31 | 80 | | | | | |
| 229 | 60 | | | | | | |
| 234 | 42 | 70 | | | | | |
| 238 | 51 | | | | | | |
| 240 | 62 | 80 | | | | | |
| 246 | 72 | | | | | | |
| 252 | 11 | 22 | 33 | 44 | 54 | 64 | 80 |
| 258 | 72 | | | | | | |
| 264 | 62 | 80 | | | | | |
| 266 | 51 | | | | | | |
| 270 | 42 | 70 | | | | | |
| 275 | 60 | | | | | | |
| 276 | 31 | 80 | | | | | |
| 280.5 | 50 | | | | | | |
| 282 | 70 | | | | | | |
| 288 | 20 | 40 | 60 | 80 | | | |
| 294 | 70 | | | | | | |
| 298.5 | 50 | | | | | | |
| 300 | 31 | 80 | | | | | |
| 301 | 60 | | | | | | |
| 306 | 42 | 70 | | | | | |
| 310 | 51 | | | | | | |
| 312 | 62 | 80 | | | | | |
| 318 | 72 | | | | | | |
| 324 | 11 | 22 | 33 | 44 | 54 | 64 | 80 |
| 330 | 72 | | | | | | |
| 336 | 62 | 80 | | | | | |
| 338 | 51 | | | | | | |
| 342 | 42 | 70 | | | | | |
| 347 | 60 | | | | | | |
| 348 | 31 | 80 | | | | | |
| 352.5 | 50 | | | | | | |
| 354 | 70 | | | | | | |

The table above is useful in understanding the operation of the process in creating a coarse map of best degree-of-fit signals in equiangular steps in attitude. The relevance of a map the cells of which are in steps as described in connection with Table I above may be appreciated in part by reference to the discussion relating to Equation 6 in this description and partly by reference to the more detailed descriptions of various aspects of the invented process below.

Before proceeding with a full description of the detailed steps of a process in accordance with the invention it may be useful to consider some definitions of specific terms used in that description and of some principles evolved in developing the process. While a mathematical notation is used in the course of defining such terms and some expressions may be written out in such notation it should be clear that this notation is only for the purpose of explaining various aspects of the process and that the process itself is the operation of special purpose circuitry or general purpose circuitry arranged by programming to carry out one or more steps of the process, and that the operation of such circuitry is of course independent of whether the process is explained in the notation referred to here or is explained in terms of describing the progress of electrical signals through the circuitry. The description in terms of this notation is therefore solely for the purpose of making the specification more concise and more easily understandable in terms of its principles than would be the case had the process been described in terms of the progress of various electrical signals through various circuit elements.

Figure 9:
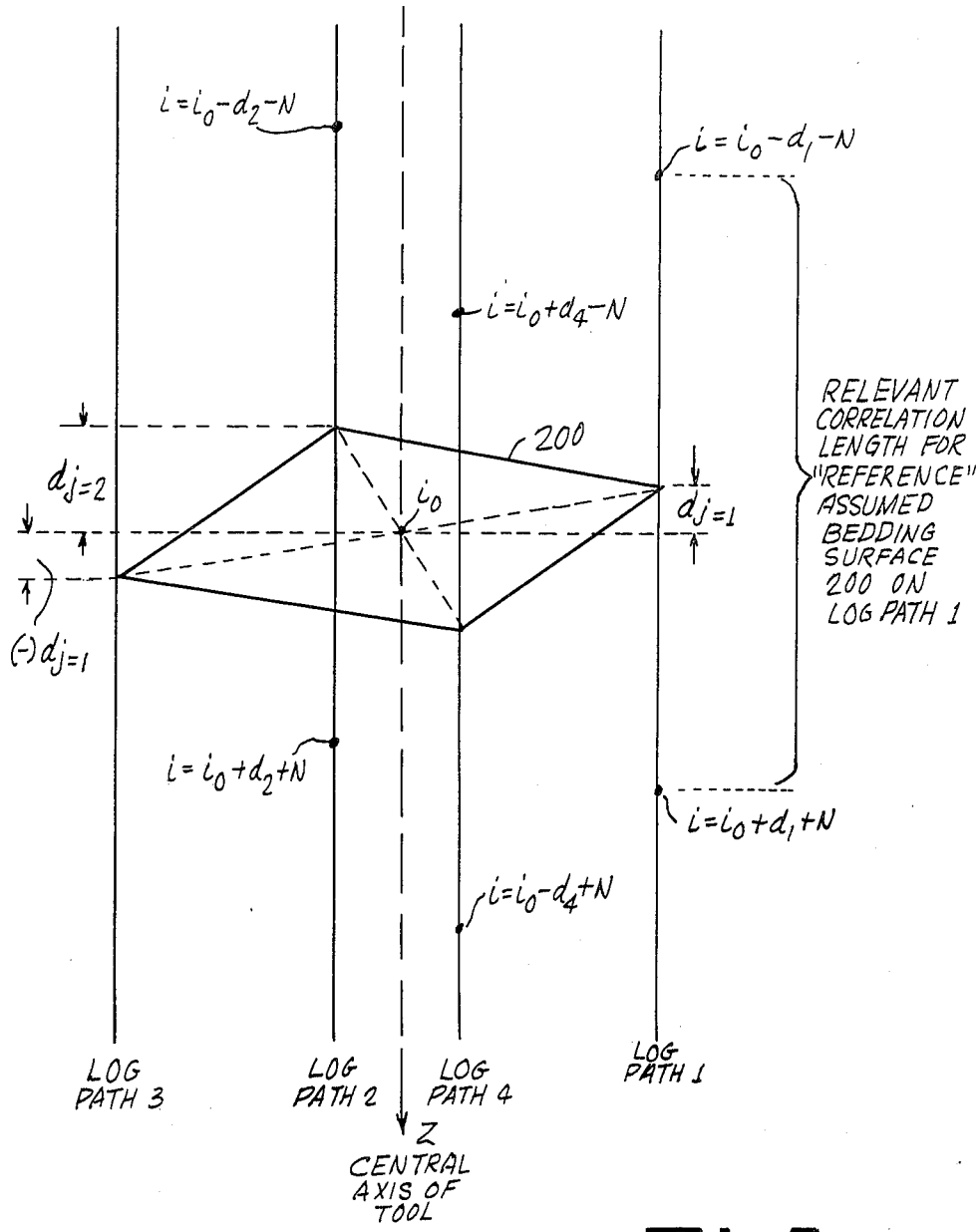
FIG. 9 illustrates an alternate schematic diagram of log samples which are produced by the investigating tool and define an assumed bedding surface.

Referring to FIG. 9 to help in establishing the terms of interest, the four solid vertical lines represent the paths along the borehole at which the respective logs are taken and they are labelled "Log Path 1" through "Log Path 4" in the same way as in FIG. 6. The following terms are defined in relation to FIG. 9:

$i_o$—This is the correlation depth of a given assumed bedding surface. (Actually it is the depth in the borehole of the "reference" surface of a set of surfaces parallel to it which intersect the respective log paths within the respective correlation lengths related to the assumed bedding surface.)

i—The depth index for log samples measured up or down the respective log path from depth $i_o$ in increments of one log sample. For example, referring to the "reference" assumed bedding surface 200 in FIG. 9, the intersection point of that surface with Log Path 1 is i log samples up from the correlation depth $i_o$ while the intersection point of the same surface with Log Path 4 is i samples down from the correlation depth $i_o$, it being understood that the value of the index i would be different in the case of these two intersection points.

M—This is the number of log paths used in the process. For example, four log paths are illustrated in FIG. 9, but it should be understood that a different number of log paths can be used in the invented process. For example, there are dipmeter tools which carry two measuring devices per pad, and a four-pad tool of this type would derive eight logs, and the process described here may use eight instead of four log paths. In general it is easier if the number of log paths is an even number, but this is not essential in principle.

j—This is an index identifying a specific one of the M log paths.

2N+1—This is the number of log samples in one correlation length of one log path. It is desirable that N be an even number but this is not essential in principle.

$d_j$—This is the depth difference, in units of one log sample increment, between the correlation depth $i_o$ and the point on log path j where the "reference" assumed bedding surface intersects the path of log j. In the example illustrated, where there are four diagonally opposed log paths, and assuming that the correlation depth point $i_o$ is at the center of each diagonal, it should be clear that $d_j = -d_{j+M/2}$.

$X_j^i$—This is the log sample on the path of log j which is at depth index i up or down as the case may be from the correlation depth $i_o$.

$X_{av.}^{i=dj}$—This is the average value of the log samples which are at the intersection points of the "reference" assumed bedding surface with the four log traces. In the example of FIG. 9 this is the average of the log samples at the four points at the ends of the illustrated diagonals which define the illustrated reference surface. This average may be derived for example by adding the values of the four relevant log samples and dividing the resulting sum by 4.

$X_{av.}^{i}$—This is the average of the log samples which are at the intersection with the log paths of any one of the assumed bedding surfaces which are parallel to the "reference" surface and are within the relevant correlation lengths.

$X_{av.}^{i,j}$—This is the average value of the log samples within the correlation length of a given log trace j which correlation length is centered at the intersection of the log trace j by the "reference" assumed bedding plane which is being considered.

$X_{av.}$—This is the average of all of the log samples on all of the M log paths which log samples are within the respective correlation lengths for the given assumed bedding surface. For example, this can be derived by adding up the values of the relevant log samples and dividing the resulting sum by the quantity $M\times(2N+)$, which is the total number of the relevant log samples.

$E_j$—This is the difference in value between two of the signals defined above. Specifically, it is defined as $E_j=X_j-X_{av.}$.

Figure 10:
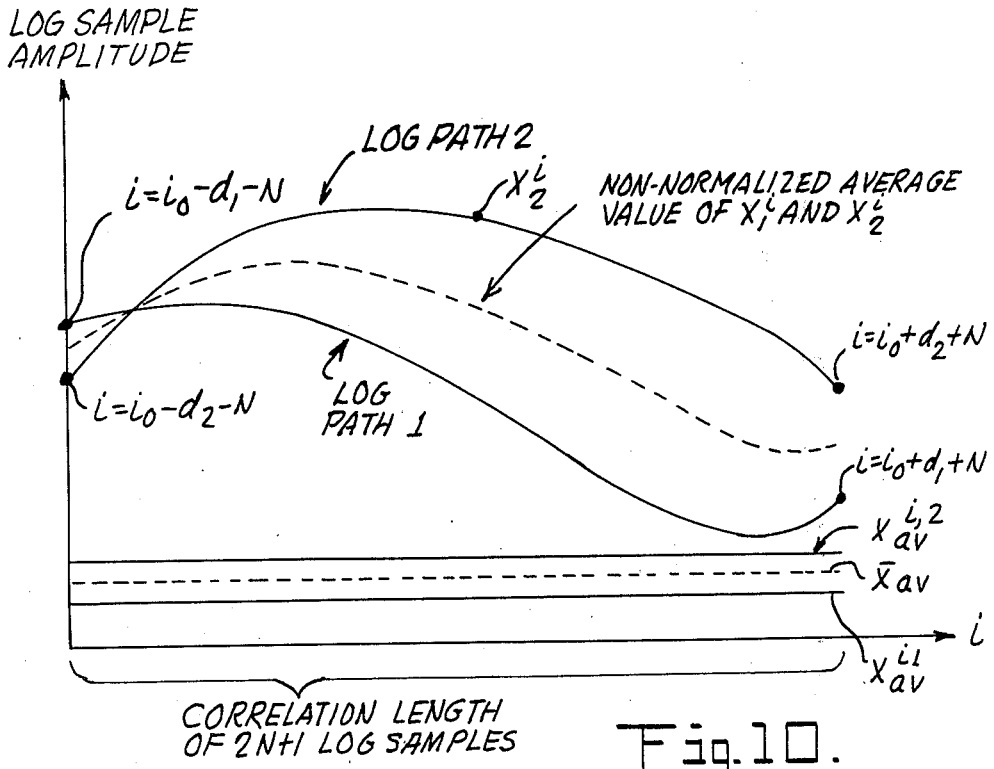
FIG. 10 is a graphical representation of exemplary portions of logs in accordance with the invention.

A number of the terms defined above are illustrated on FIG. 9 and the remainder can be visualized by referring to the illustration at FIG. 10. For simplicity FIG. 10 illustrates the log samples of only two paths, but the principles discussed in connection with it apply to four paths or in the general case M paths. In FIG. 10 the horizontal axis is in units of log sample increments or, stated differently, in units of the index i. The vertical axis is in amplitude of log samples. The log values of two log paths are illustrated: those of Log Path 1, and of Log Path 2 or, stated in the more general notation those of Log Path j and those of Log Path j+1. The correlation lengths of the two logs for a particular assumed bedding surface are illustrated, that is the illustrated curve of the correlation length of log 1 starts at a value of the index i which is at the bottom of the relevant correlation interval, or at $i=i_0+d_1+N$ and ends at an index i which is at $i=i_0-d_1-N$. Similarly the illustrated correlation length of log 2 starts at an index i which is $i=i_0+d_2+N$ and ends at an index i which is $i=i_0-d_2+N$. The average of the two illustrated curves of the log samples along the correlation lengths of the respective log traces is illustrated and labelled $X_{av.}^{(i\pm dj)}$. The quantities $X_j$ for each of the two illustrated log portions are constants, generally of different attitudes and are so illustrated at FIG. 10. The quantity $X_{av.}$ is also a constant illustrated as a horizontal line between the horizontal lines illustrative of the quantities $X_j$ for the two log portions.

FIGS. 9 and 10 were used in explaining the significance of various terms used in connection with two or more correlation length of log samples. In the more general context of the process in accordance with this invention, what is of interest is the degree of fit between, say, four or more relevant correlation lengths of log samples. However, with the concepts developed above, one can appreciate that one way to visualize such a degree of fit is by the expression below, where a degree-of-fit signal is expressed as a function of the various signals terms for which were discussed above.

$$\frac{\sum_{i=i_o+d_j-N}^{i=i_o+d_j+N}\sum_{j=1}^{M}(X_j^i - X_{av.}^{i,j} - E_j)}{\sum_{\substack{i=i_o+d_j-N\\ j=1}}^{\substack{i=i_o+d_j+N\\ j=M}}(X_{av.}^{i,j} - \bar{X}_{av.})} = C \qquad \text{(Eq. 10)}$$

The expression immediately above is only a description of the significance of the relevant parts of the invented process. It is used only as a way to explain the principles of a particular embodiment of the process. In general, this expression means that the signals combined with each other to produce the degree-of-fit signal are the samples of a total of M correlation lengths of M log paths. The correlation length of each given log path (the j-th path) is centered at the point of intersection of the "reference" assumed bedding surface of interest with that log path. The expression indicates the particular type of combination used to derive the relevant degree-of-fit signal or the given bedding surface of interest in one possible embodiment of the invention. In fact, the preferred embodiment of the invention as described below uses a similar procedure but does not use the quantity $E_j$ or the quantity $X_{av.}$. The expression immediately above would apply to a description of the preferred embodiment if these two quantities are dropped from it.

By reference to the expression immediately above it can be seen that when the absolute value of the degree-of-fit signal labelled C in the expression above (or in the modified expression related to the preferred embodiment of the invention discussed below) is small, this means that the relevant correlation lengths of log samples combined with each other to derive the degree-of-fit signal are very similar to each other. This of course means that the attitude of the particular assumed bedding surface being considered is likely to be close to the attitude of the geological feature of interest. Conversely, when the absolute value of the same degree-of-fit signal is large this means that the relevant correlation lengths are dissimilar and that it is likely that the assumed bedding surface being considered has an attitude which does not correspond to the attitude of a geological feature of interest. In fact, in the preferred embodiment of the invention discussed in detail below the degree-of-fit signal labelled C is rescaled to a degree-of-fit signal labelled CC by a process which can be described by the expression $CC=100\ (10-C)$ such that the best possible similarity between the relevant correlation lengths results in a high value of the degree-of-fit signal labelled CC and a poor similarity results in a low value of the degree-of-fit signal labelled CC.

It should be clear that the particular way of combining the relevant correlation lengths discussed above is only a preferred one and that other correlation techniques that may be applicable to getting a measure of the degree of similarity between a number of correlation lengths of log samples may be used instead.

Figures 11, 12:
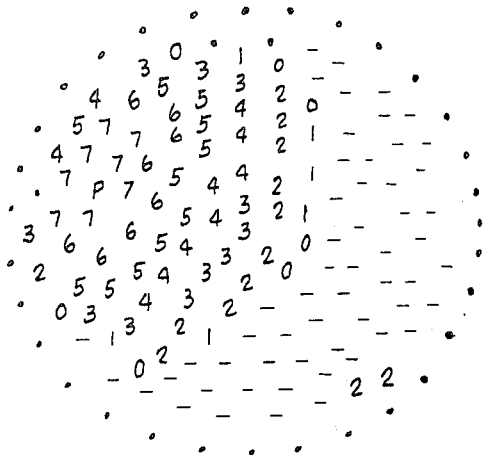
FIG. 11 illustrates an exemplary two-dimensional map of degree-of-fit signals at equiangularly distributed cells of a hemisphere.
FIG. 12 illustrates a planar, two-dimensional, finer map of degree-of-fit signals.
Figure 13A:
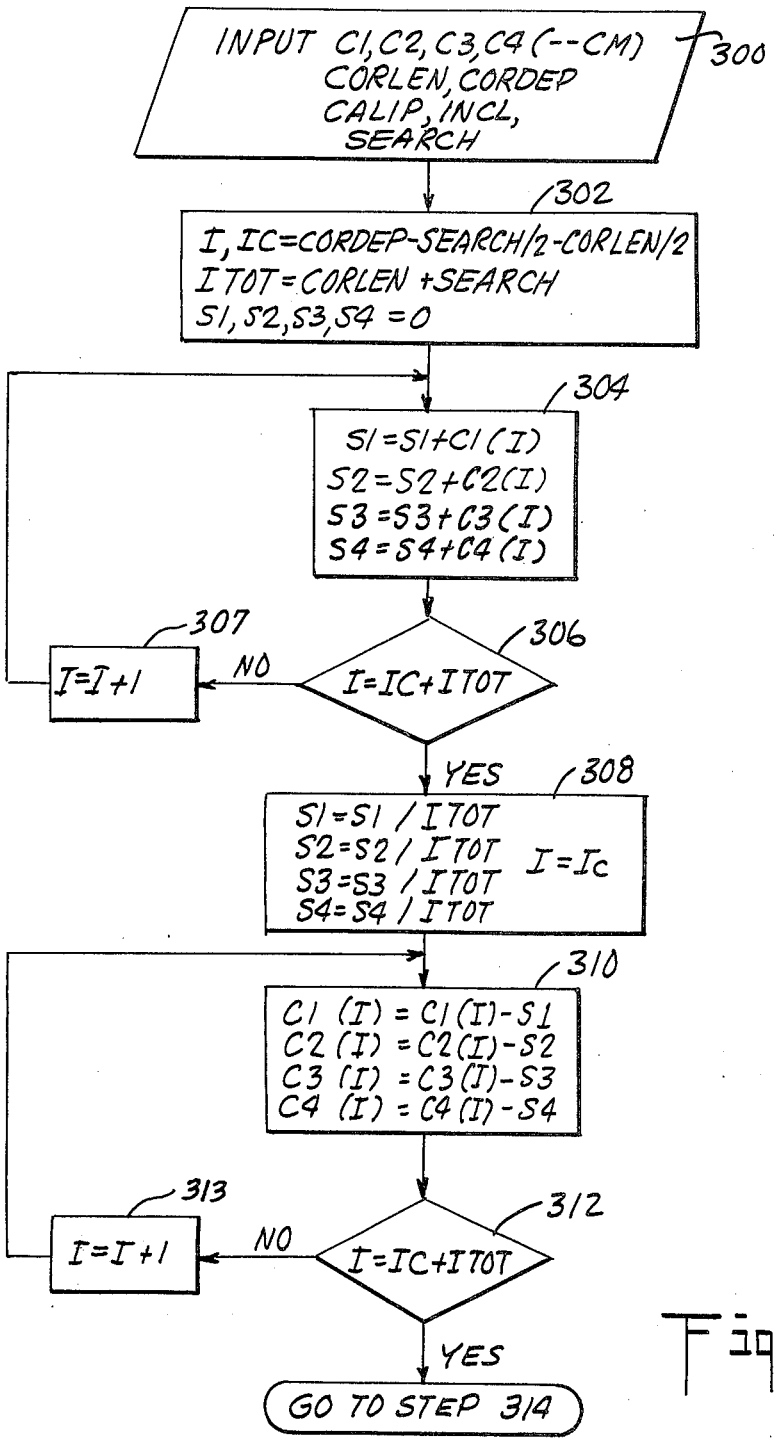
FIGS. 13*a*–13*e*, 14 and 15 are a flow chart aiding in a description of a preferred embodiment of the invention.
Figure 13B:
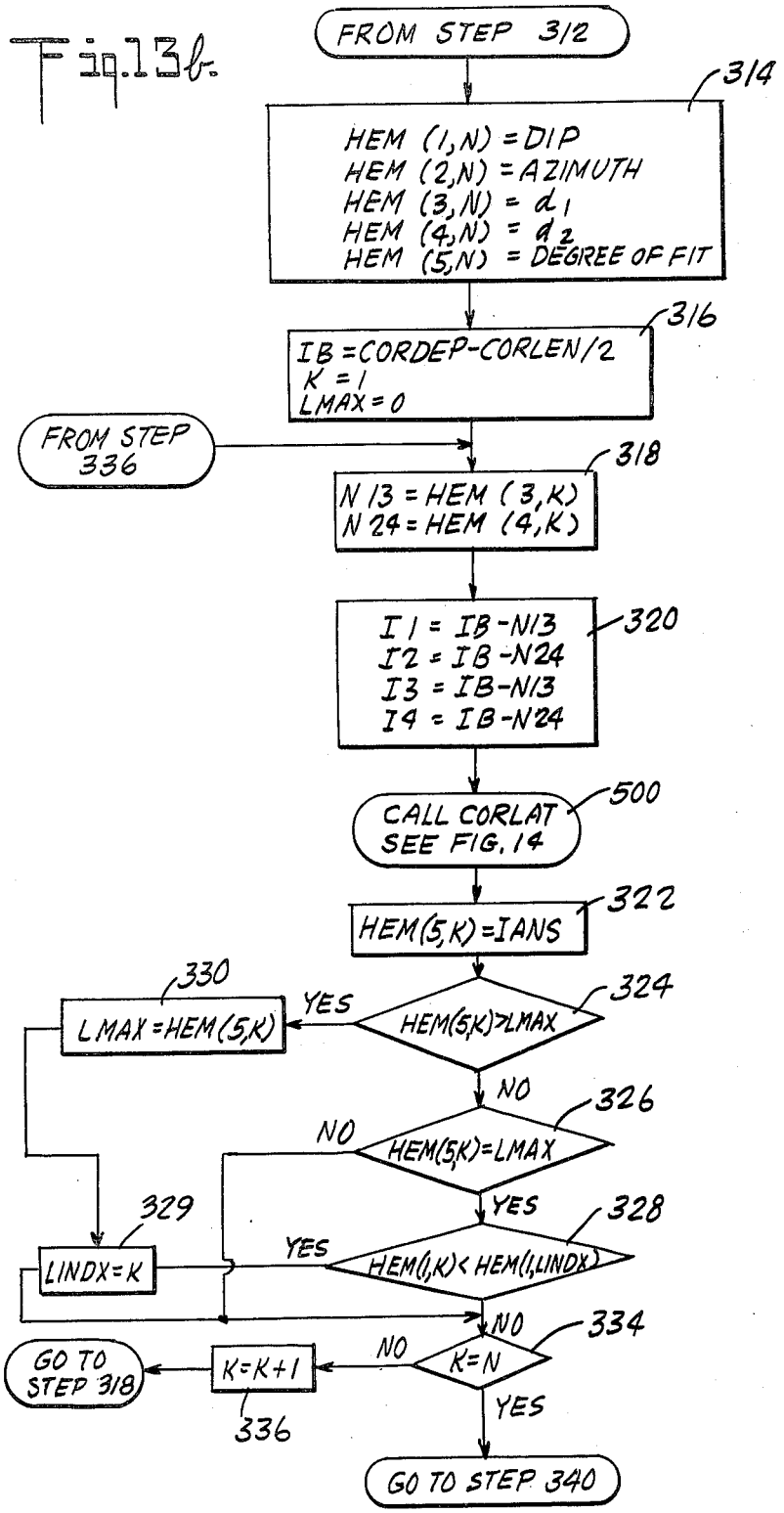
Figure 13C:
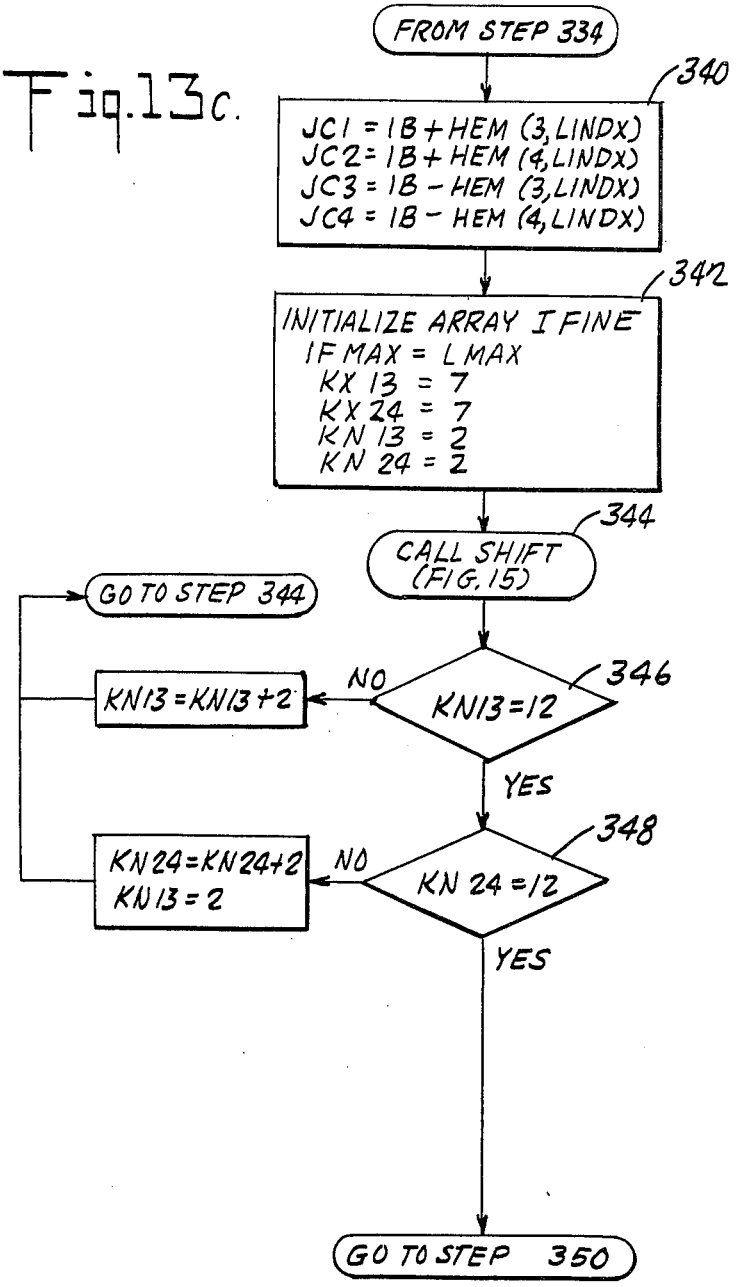
Figure 13D:
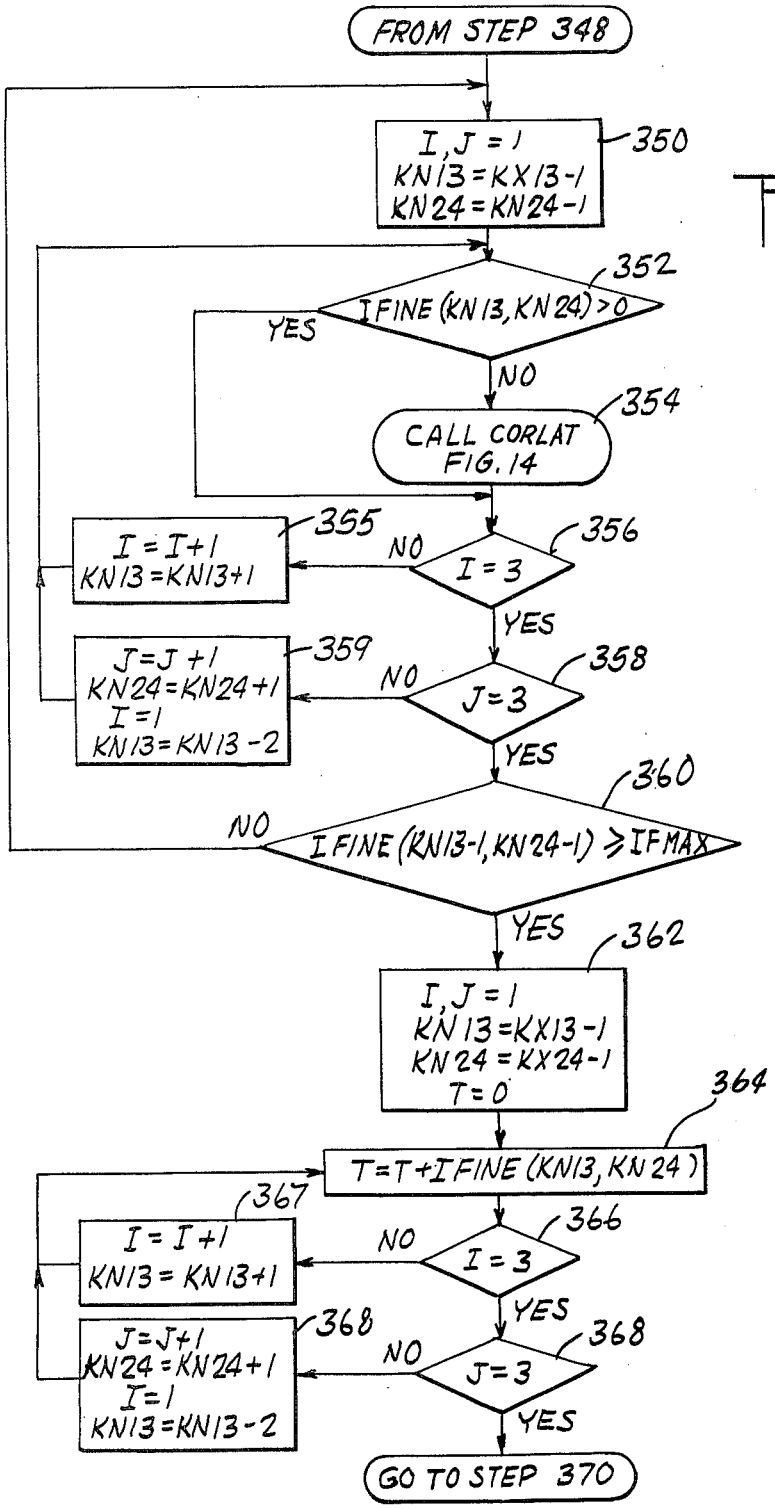
Figure 13E:
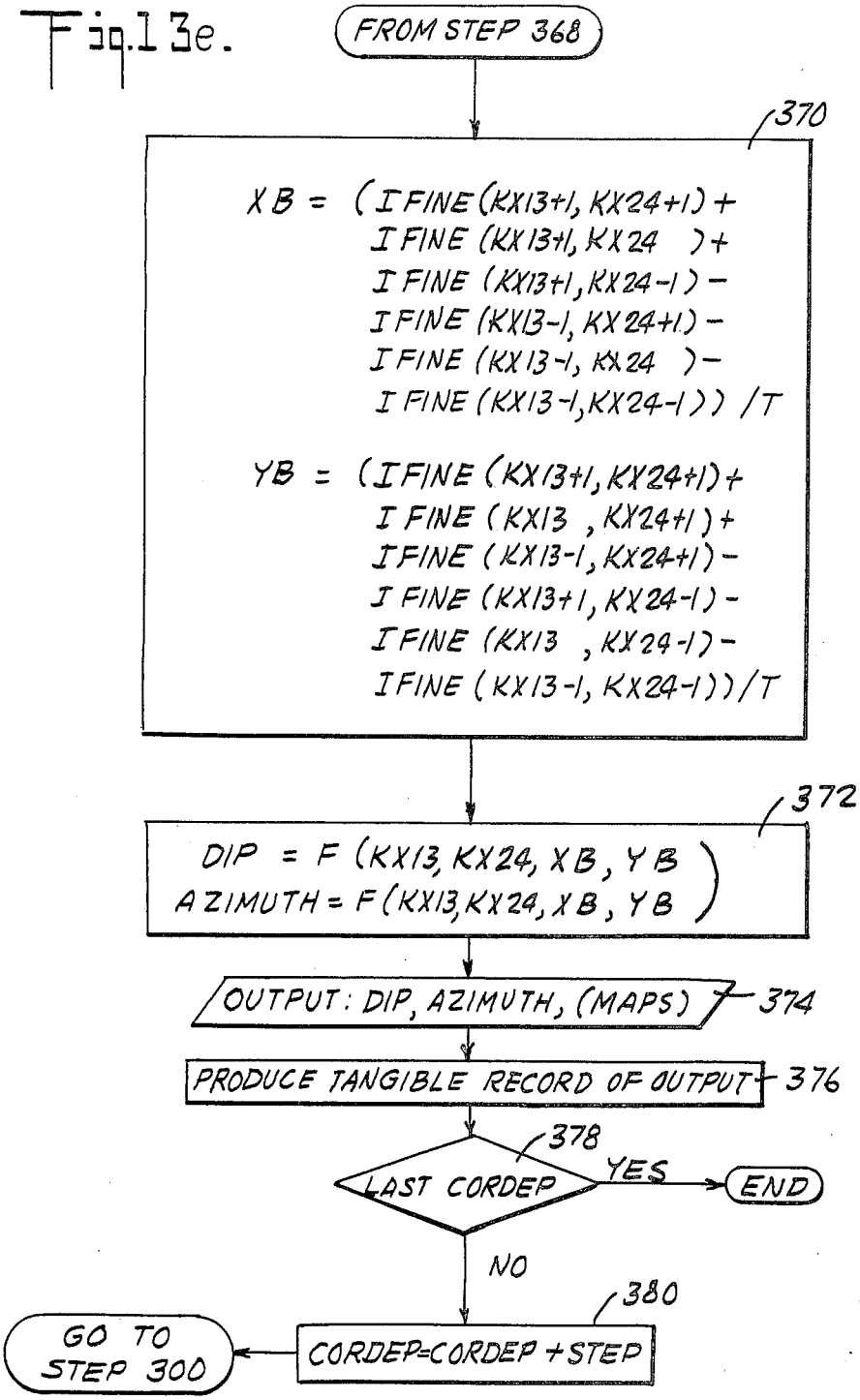

With reference to the terms defined above, the major functional steps of a preferred embodiment of the invented process are listed below, and are discussed below by referring on occasion to the illustrations at FIGS. 11 and 12, and detailed steps of a preferred embodiment of the process are discussed later in connection with FIGS. 13–17.

The major functional steps of the preferred embodiment of the process are:

1. Select the correlation depth of interest. At the beginning of the process this would be an initial correlation depth, for example at or near the bottom of the borehole and, as the process progresses, the selected correlation depth would be incremented by one correlation step at a time until the top of the borehole is reached;
2. Select the attitude of the assumed bedding surface of interest. At the first pass through this step, an initial attitude is selected. For example, this initial attitude may be that of an assumed bedding surface which is normal to the tool axis (e.g., each of the quantities $d_j$ illustrated in FIG. 9 would be 0). As the process progresses the selected attitude would be that of the next assumed bedding surface of interest, this incrementing being in uniform steps of attitude as discussed in connection with Table I above. In any event, in this step the selected attitude is identified by appropriate values of the quantities $d_j$ illustrated at FIG. 9;
3. read out the relevant log samples. The relevant log samples may be those within the relevant correlation length for the "reference" assumed bedding surface as illustrated in FIG. 9;
4. Produce a degree-of-fit signal as a function of the M relevant correlation lengths and store the produced degree-of-fit signal in the cell of a coarse hemispherical map which corresponds to the attitude selected in Step 2. This coarse hemispherical map is as discussed in connection with Table I above; an example of such a coarse hemispherical map, when projected on a plane, is shown on FIG. 11. Each of the numerals and each of the dashes appearing on FIG. 11 is an example of a degree-of-fit signal stored in a cell of the coarse hemispherical map;
5. Find out if each of the cells of the coarse hemispherical map already contains a degree-of-fit signal. If the answer is no, then select another attitude which corresponds to another, empty cell of the coarse map, and go back through Step 2 and the following steps using this time the parameters (e.g., the values for $d_j$) which define the bedding surface having the new selected attitude. If the anwer at Step 2 is yes, go on to Step 6;
6. This step is reached once the cells of the coarse map are filled in. In this step find the best degree-of-fit signal in the coarse map and store the map coordinates of this best degree-of-fit signal;
7. Overlay a finer map on the region of the coarse map which contains the best degree-of-fit signal. The finer map map be a cartesian map, of the kind illustrated in FIG. 12 and also of the kind discussed previously in connection with FIG. 8, and its origin (the 0, 0 coordinates) is centered at the cell of the coarse map which contains the best degree-of-fit signal. While the coordinates in the coarse map are in values of $\theta$ and $\phi$ and the coordinates of the finer map are in values of $d_j$, the geometric relationships necessary for conversion are known;
8. Produce and store respective degree-of-fit signals for the cells forming a checkerboard pattern of selected cells on the finer map. For example, as illustrated in part in FIG. 12, only every other cell of the finer map is filled in at this time. As in Step 4 the degree-of-fit signals may be produced as discussed in connection with Equation 10 above or as discussed in connection with the simplified version of Equation 10 (where the last term of the numerator and the last term of the denominator are omitted) or in accordance with another correlation technique. In this Step 8 an initial cell of the finer map is identified, the degree-of-fit signal corresponding to it is found, then a test is made to find if all of the selected cells have been filed in; if not, another cell is indentified in the checkerboard pattern, the degree-of-fit signal for that new cell is found, and again a test is made to see if all of the selected cells of the finer map have been filled in. When the answer is yes, the process goes on the Step 9;
9. In this step the process finds the coordinates of the best degree-of-fit signal among those stored in a checkerboard pattern in the finer map. The best degree-of-fit signal found at this time is termed an initial best degree-of-fit signal;
10. In this step the process produces and stores degree-of-fit signals in each of the cells of the finer map adjacent the cell containing the initial best degree-of-fit signal. Referring to FIG. 12 as an example, the initial best degree-of-fit signal is at the cells having coordinates 3, −3 and the process in this step produces and stores the degree-of-fit signals for the eight immediately adjacent cells;
11. In this step the process finds an intermediate best degree-of-fit signal, which is the best degree-of-fit signal contained in the cells for the initial best degree-of-fit signal and the eight immediately adjacent cells. In the case of FIG. 12, the initial best degree-of-fit signal and the immediate best degree-of-fit signal happen to coincide;
12. In this step the process identifies the degree-of-fit signal which is at the central cell of the part of the finer map where all the cells are filled in. In the example of FIG. 12, this happens to be the cell having coordinates 3, −3;
13. A test is made to find if the intermediate best degree-of-fit signal is stored in the central cell found in the preceding step. If the answer is no, the process returns to Step 10 and in this pass through Step 10 the process produces and stores the degree-of-fit signals for all cells immediately adjacent to the central cell found in Step 12. If the answer in Step 13 is yes, the process goes on to Step 14;
14. In this step the process finds the coordinates of the center of gravity of the degree-of-fit signals in the central cell and its immediately adjacent cells. The coordinates of this center of gravity are indicative of the attitude of an assumed bedding surface and this attitude is most likely to correspond to the attitude of an earth formation feature at the relevant depth in the borehole;
15. In this step the process produces a tangible record of the relevant characteristics of the assumed bedding surface found in the preceding step. This tangible record may comprise a normalized degree-of-fit signal recorded in an appropriate location in a map of the type illustrated in FIG. 11, it may comprise a tangible record of the apparent dip and apparent azimuth of the relevant assumed bedding surface as well as the depth of the "reference" assumed bedding surface, it may comprise a tangible record of the true dip and true azimuth of the relevant assumed bedding surface (found as discussed above), and/or it may comprise a tangible record of other characteristics of the relevant assumed bedding surface. This tangible record is at the graphic output device 70 shown in FIg. 1;

16. In this step the tangible record produced in Step 15 is combined, in full or in part, with any tangible records for the relevant assumed bedding surfaces at other correlation depths, for example again at the graphic output device 70 shown in FIG. 1;
17. In this step the process checks to see if the assumed bedding surface found as discussed in the preceding steps is at the last correlation depth of interest. If the answer is no, the process returns to Step 1 but this time the correlation depth selected at Step 1 is the next adjacent to the one for the previous run through Steps 1 through 17. If the answer at Step 17 is yes, then the process produces a combined tangible record as a result of Step 16 and ends.

Figure 14:
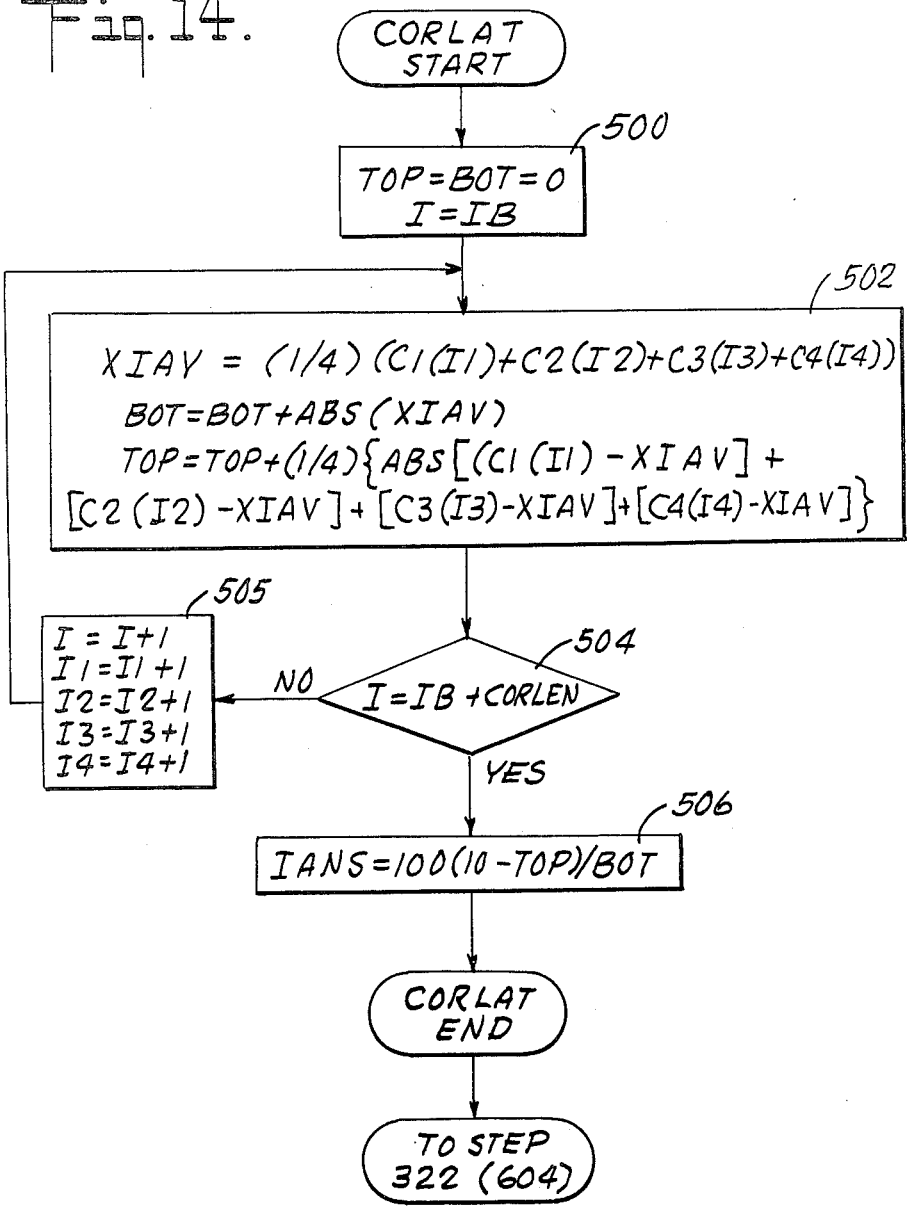
Figure 15:
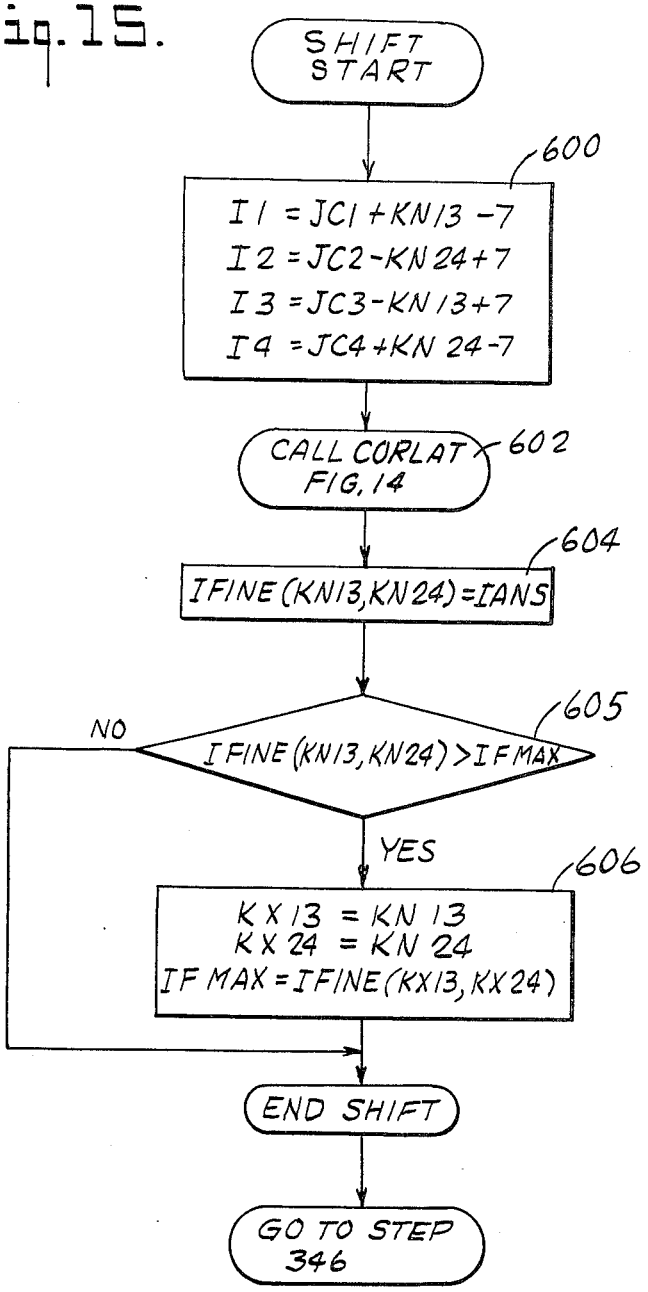

The steps of a specific detailed implementation of the invented process are shown in FIGS. 13–15. This particular implementation is by means of arranging a general purpose digital computer such as a system available from Digital Equipment Corporation under the generic designation PDP-11/45. These steps can be expressed in high level languages such as Fortran, which can be converted by known compilers into a machine language form suitable for being in turn converted to instructions stored as electrical or magnetic signals in appropriate parts of the computer. Applicants consider it more informative and concise to describe the steps of this particular embodiment of the invention in terms of a detailed flow chart where each step of the flow chart is directly expressible in a high level language statement (or at most a low number of such statements), in order to simplify the understanding of this aspect of the invention.

Figure 16:
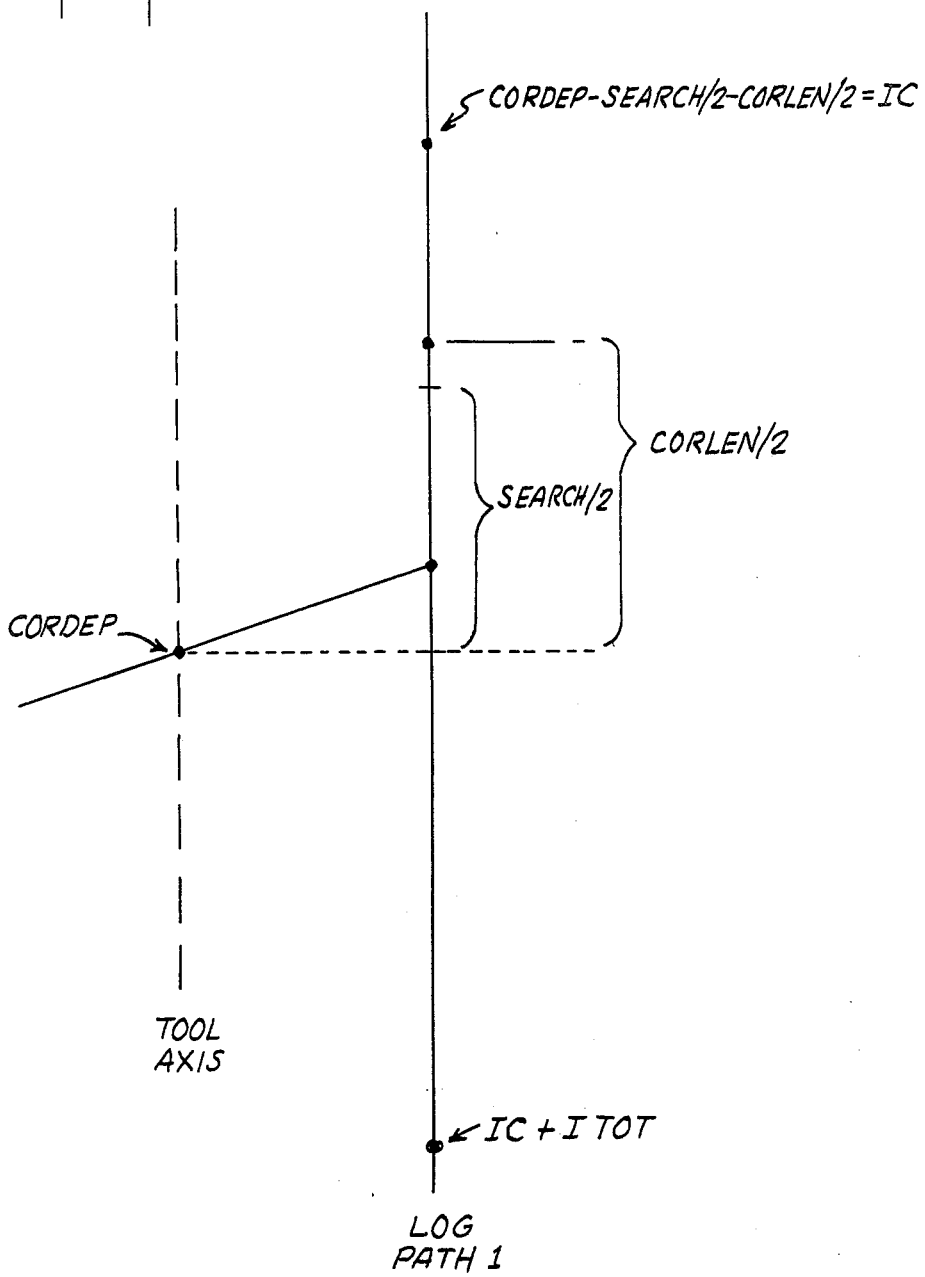
FIGS. 16 and 17 are schematic illustrations of log path portions aiding in the description of terms used in connection with FIGS. 13–15.

Referring to FIG. 13, the computer system is provided with signals representing the following: arrays C1 through C4 in computer memory for storing the log samples from Log Paths 1 through 4 respectively (and any other arrays of this type in case needed to accommodate additional log paths); the correlation length CORLEN; the correlation depth CORDEP; the caliper CALIP and the inclination INCL of the tool at the time the relevant log samples are measured; and a parameter SEARCH, which is the search angle expressed in units of depth difference. Referring to FIG. 16 for an illustration of the physical significance of the input parameters, the correlation depth is marked on the tool axis and only Log Path 1 is shown for simplicity, it being understood that similar illustration apply to the other log paths of interest. The correlation length is centered at the correlation depth and half of it extends above the correlation depth. The SEARCH is also centered at the correlation depth and is generally somewhat less than the correlation length. The parameter SEARCH may be derived from the knowledge of the tool caliper and inclination relative to a particular correlation length for a particular correlation depth of a particular log path and the geometry of the tool.

Once the various parameters have been set at Step 300, the purpose of Steps 302 through 312 is to find, for each log path, the normalized value of the samples which are within a length of the log path equal to the sum of the correlation length and the search length, this sum being centered at the correlation depth. The normalization is relative to the average value of the samples of the relevant log path which are within the length of the log path equal to the sum of the correlation length and the search length. Thus, in Step 302 the process establishes a pointer IC to point at a point on each of the log paths which is above the correlation depth by a distance which is equal to half the sum of the correlation length and the search length and sets a pointer I to initially point to the sample which is at the point IC of the log path. In the same Step 302 the process establishes a constant ITOT which is equal to the sum of the correlation length and the search length, and sets each of variables S1 through S4 to 0. Then, in a loop made up of Steps 304, 306 and 307 the process makes each of the variables S1 through S4 equal to the sum of the log samples of the relevant log path over the portion of the log path which is equal to the sum of the correlation length and search length, this sum being centered at the correlation depth. In particular, at Step 304 the variable S1 is updated to the sum of its previous value and the sample of Log Path 1 identified by the current value of the index I and the variables S2 through S4 are similarly updated. In Step 306 a test is made to see if the index I points to the bottom of the log portion of interest (as illustrated in FIG. 16). If the answer is no, the index I is incremented and another run is made through Steps 304 and 306. If the answer at Step 306 is yes, this means that the bottom of the part of interest of the log paths has been reached, and the process goes on to Step 308.

The purpose of Step 308 is to find the average value of the samples of the respective logs over the appropriately centered sum of the correlation length and the search length. To do this the variable S1, which at this time is the sum of the relevant log samples of Log Path 1 is divided by the constant ITOT and the quotient becomes the new value of the variable S1. The variables S2 through S4 are similarly treated, and then the pointer I is again set to point to IC so as to start a new run through the relevant lengths of the log paths.

In a loop made up of Steps 310, 312 and 313 the process subtracts the average value of the samples along the relevant length of a given log path from each of the respective samples of that log making up that relevant length and stores the resulting normalized samples. In particular, at Step 310 the average value of the samples along the relevant length of Log Path 1 is subtracted from the sample of Log Path 1 pointed to by the index I at the time and the resulting normalized sample is stored at a location in a suitable array pointed to by the index I at the time, and the remaining log paths are similarly treated. At Step 312 a test is made to see if the bottom has been reached of the relevant length of the log paths, if the answer is no the index I is incremented at Step 313 and another run is made through Steps 310 and 312, and if the answer is yes the process goes on to Step 314.

In going through Steps 314 through 340 the process sets up the hemispherical map discussed above, finds the degree-of-fit signal corresponding to each of its cells and stores it in the respective cell. This part of the process starts at Step 314 where an array is set in the computer memory for the hemispherical map by providing for each cell of the map a five-entry cell member. As indicated at Step 314 the first entry of a cell member contains a signal representing the dip angle corresponding to that cell member (as discussed in connection with Table I above), the second entry contains a signal representing the azimuth angle, the third entry contains a signal representing the distance $d_1$ discussed in connection with FIG. 9 and again illustrated at FIG. 17 and the fourth entry contains a signal representing the distance $d_2$ also discussed in connection with FIG. 9 and again illustrated at FIG. 17. The fifth entry of each cell member is empty at this time but will later contain the degree-of-fit signal found for that cell member.

Figure 17:
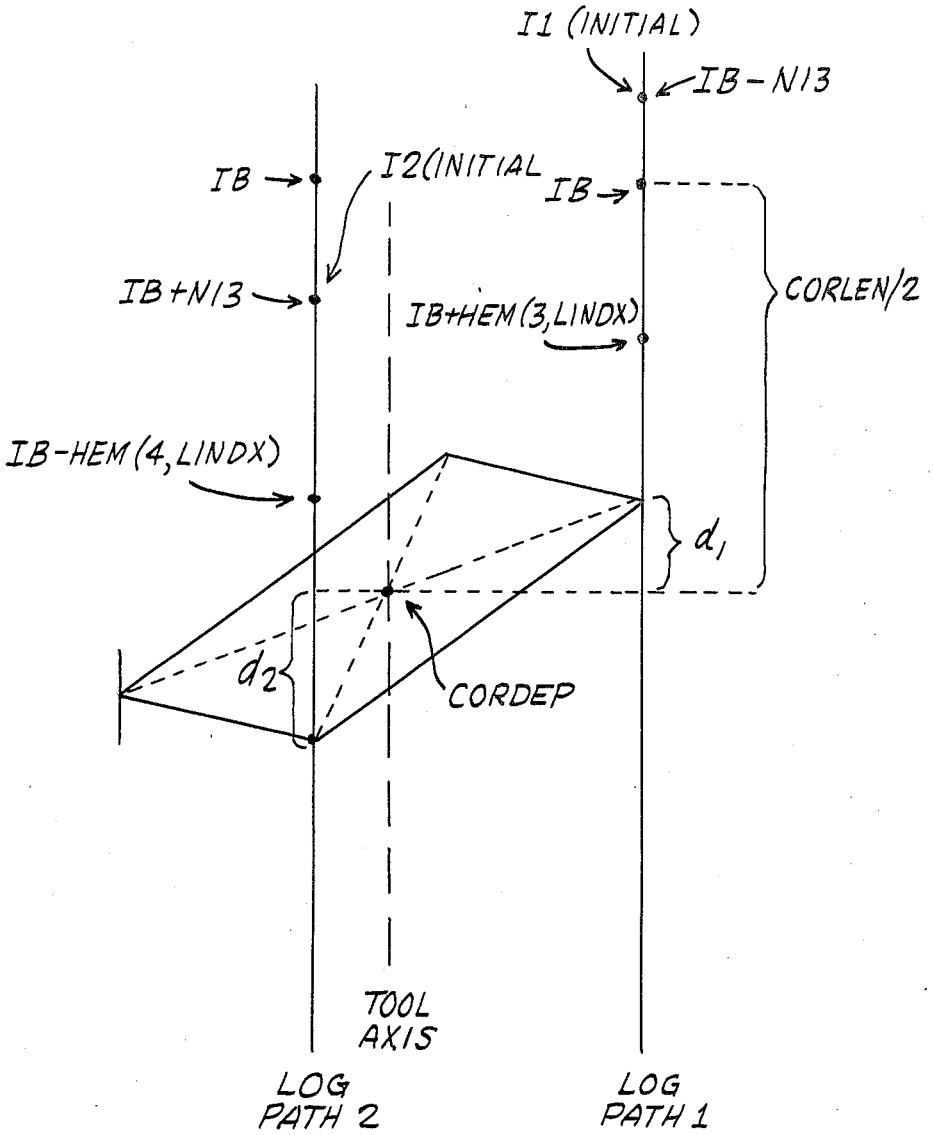

At Step 316 a constant IB is found as indicated to point, as illustrated in FIG. 17, to the top of the correlation length centered at the correlation depth of interest, an index K is set to 1 to point to the first cell of the N-cell array for the hemispherical map, and a variable LMAX is set to 0.

At Step 318 the variables N13 and N24 are set as indicated. The significance of these variables is that, for a given assumed bedding surface identified by the current value of the index K (which points to a given cell of the hemispherical map) the variable N13 is the distance between the correlation depth and the intersection of the "reference" assumed bedding plane with Log Path 1 and the variable N24 is the similar intersection with Log Path 2. In the case illustrated in FIG. 17 the variable N13 is the same as the distance $d_1$ and N14 is the same as the distance $d_2$.

At Step 320 the pointers 11 through I4 are found as indicated. The physical significance of the pointer I1 in the first run through Step 320 is that it points to the top sample on Log Path 1 of the correlation length centered at the intersection of the "reference" assumed bedding surface of interest with Log Path 1 (as illustrated in FIG. 17). The other pointers have the corresponding significance with respect to the other log paths. The process then goes on to Step 500 of a subprocedure CORLAT illustrated at FIG. 14. The purpose of the subprocedure CORLAT is to find the degree-of-fit signal which is to be stored in the fifth entry of the cell of the hemispherical map identified by the current value of the index K. To do that the subprocedure uses the normalized samples derived in the loop through Steps 310, 312 and 313 and goes through a procedure which can be generally described as in the discussion related to Equation 10 above with the last term of the numerator and denominator of the equation dropped. In particular, at Step 500 of the subprocedure of FIG. 14 each of variables TOP and BOT is set to 0 and an index I is set to point to a point on the tool axis which is half a correlation length above the correlation depth considered at the time. At Step 502 a variable XIAV is evaluated for the current value of the index I and the current values of the indices I1 through I4. For the current value of the relevant indices the variable XIAV is the average of the log samples, one from each log path, at the intersection of a surface parallel to the "reference" assumed bedding surface with the log paths. The variable BOT is set to the sum of its previous value and the absolute value of the just evaluated variable XIAV and the variable TOP is set as indicated to the sum of its previous value and the average of the sum of the absolute values of the relevant log samples normalized to the current value of the variable XIAV. At Step 504 a test is made to see if the bottom of the relevant correlation length has been reached and, if not the indices of interest are incremented at Step 505 and another run is made through the loop. When the answer at 504 is yes, a variable IANS is evaluated as indicated to give the degree-of-fit signal relevant to the cell of the hemispherical map identified by the current value of the index K. Returning now to FIG. 13, this just evaluated degree-of-fit signal is stored at Step 322, in the fifth entry of the relevant cell of the hemispherical map array.

Once the degree-of-fit signal for the relevant cell of the hemispherical map has been found and stored in the relevant entry at Step 322, a test is made at Step 324 to see if it exceeds the current value of the variable LMAX. In the first run through Step 324 the answer is likely to be yes, since LMAX was set to 0 at Step 316. In that case the process sets the current value of LMAX to the current degree-of-fit signal at Step 330, and sets a pointer LINDX at 329 to point to the current cell of the hemispherical map, which at this time is the cell containing the best degree-of-fit signal. The process goes on to Step 334 to find if the last cell of the hemispherical map array has been reached. If the answer is no, the index K is incremented at 336 to point to the next cell and the process returns to Step 318 to go through a similar run but this time for another cell of the hemispherical map array and therefore an assumed bedding surface at another attitude.

When the answer at Step 324 is no, meaning that the just found degree-of-fit signal is not greater than the previously found one, the process tests at Step 326 whether the just found degree-of-fit signal is equal to the best one found to date. If the answer is no, the process goes on to Step 334 discussed above. If the answer is yes, a test is made at Step 328 to see whether the assumed bedding surface currently considered has a lesser dip than the dip of the assumed bedding surface identified by the best degree-of-fit signal found up to this point. If the answer is yes, the current degree-of-fit signal is considered to be the best degree-of-fit signal, and so stored at Step 332, on the assumption that as between two assumed bedding surfaces which have been found equally likely to correspond to an earth formation feature the one having less dip is more likely to correspond to an earth formation feature. If the answer at Step 328 is no, the process goes on to Step 334 discussed above.

When the answer at Step 334 is yes, this means that all of the cells of the hemispherical map now contain a degree-of-fit signal and the best degree-of-fit signal is in the cell identified by the current value of the variable LINDX stored as a result of process Step 332. At this time the process proceeds to overlay a finer map on the part of the hemispherical map that contains the best degree-of-fit signal of the hemispherical map and to find the best degree-of-fit signal in a checkerboard pattern of cells of the finer map. For this purpose the process starts at Step 340 by setting indices JC1 through JC4 as indicated such that the index JC1 would point to the sample on Log Path 1 which is at the top of the correlation length centered at the point on Log Path 1 where it is intersected by the "reference" assumed bedding surface found in the preceding procedures to have the best degree-of-fit, and the remaining indices would have similar significance. The significance of the indices for Log Paths 1 and 2 is illustrated in FIG. 17 for a hypothetical assumed bedding plane (not shown) which has been found to have a best degree-of-fit signal.

At Step 342 an array IFINE in the memory circuits of the computer system is initialized. This array has 169 cells corresponding to the equal number of cells illustrated at FIG. 12. A variable IFMAX, to be eventually equal to the best degree-of-fit signal found in the finer map, is set at this time to the current value of the variable LMAX which the previous part of the process has made equal to the best degree-of-fit signal found in the hemispherical map. The variables KX13 and KX24 are each set to 7, to point to the central cell of the finer map and the variables KN13 and KN24 are each set to 2, to point to a beginning cell of a checkerboard pattern of cells on the finer map. The process then goes to Step 344. which consists of a subprocedure called SHIFT and illustrated on FIG. 15. The purpose of this subprocedure is to find the degree-of-fit signal for the relevant cell of the finer map.

Referring to FIG. 15 the subprocedure SHIFT starts at Step 600 by setting indices I1 through 14 as indicated, to point to the samples at the tops of the respective correlation lengths centered at the points of intersection of the respective log paths with the "reference" assumed bedding place under consideration at this time. At Step 602 the subprocedure CORLAT illustrated at FIG. 14 is entered and when the end of the CORLAT subprocedure is reached in this case the process goes on to Step 604 to store the degree-of-fit signal found in this run of the subprocedure CORLAT in the cell of the finer map array identified by the current values of the pointers KN13 and KN24. At Step 605 the subprocedure SHIFT tests to see if the current degree-of-fit signal found for a cell in the fine map is greater than the best degree of fit found for the coarse map. If the answer is no, this particular run through SHIFT is ended and the procedure returns to Step 346. If the answer is yes, the pointers KX13 and KX24 are set to point to the cell containing the current value of the best degree-of-fit signal found for the checkerboard pattern of the finer map and the value of the variable IFMAX is similarly updated and the procedure again goes on to Step 346.

The process continues to Steps 346 through 362, where the purpose is to find the best degree-of-fit signal anywhere in the finer map (not just in the checkerboard pattern of cells) and the degree-of-fit signals which immediately surround it. This part of the process checks at Step 346 if the relevant column boundary of the finer array (FIG. 12) has been reached. If the answer is no, the column pointer is incremented by two and the process returns to Step 344 for another run through Steps 344 through 346. If the answer at Step 346 is yes, the process checks at Step 348 whether the relevant boundary of the row of the finer array (FIG. 12) has been reached. If the answer is no, the process increments the row pointer to point to the next row, sets the column pointer to point to the second column and returns to Step 344 for another run through Steps 344 through 348. When the answer at Step 348 is yes, the process goes on to Step 350 to set each of indices I and J to 1 and the column and row indicators are reset relative to the location of the best degree-of-fit signal found in the coarse map process to point to the uppermost left-hand corner of the group of eight cells surrounding the cell in the finer map containing the best degree-of-fit signal. At Step 352 the process checks if the contents of this cell of the fine map are greater than 0. If the answer is no, this means that the degree-or-fit signal has not been evaluated for this cell and the process goes on to Step 354 (i.e. the procedure CORLAT) to evaluate the necessary degree-of-fit signal. If the answer at 352 is yes, this means that there is already a value for the relevant degree-of-fit signal and the process goes on to Step 356 to test if the right-hand boundary of the 3×3 part of the fine map has been reached. If the answer is no, the relevant indices are incremented at Step 355 and the process returns to Step 352. If the answer at 356 is yes, the process checks at Step 358 if the bottom of the 3×3 portion of the finer map has been reached. If the answer is no, the relevant indices is set and incremented at 359 and the process again returns to Step 352. When the answer at 358 is yes, this means that the degree-of-fit signals for the 3×3 portion of the fine map have been evaluated, and the process checks at Step 360 if the center of this 3×3 portion indeed contains the best degree-of-fit signal. If the answer is no, the process returns to Step 358 to look for the degree-of-fit signals in a 3×3 part of the fine map which has at its center the best degree-of-fit signal in the fine map. When the answer at 360 is yes, the process goes on to Step 362 where the indices I and J are set to 1, the indices for the column and row of the fine map are set to point to the best degree-of-fit signal found up to now and a variable T is set to 0. This is in preparation for finding the center of gravity of the relevant degree-to-fit signals in the fine map.

In the center-of-gravity procedure, at Step 364 the variable T is set to the sum of its previous value and the degree-of-fit signal in the cell of the fine map pointed to by the current value of the indices KN13 and KN24. In Step 366 the process checks if the bottom end of the relevant 3×3 part of the fine map has been reached. If the answer is no, the relevant indices are incremented at 367 and the process returns to Step 364. When the bottom of the relevant 3×3 sub-array has been reached, as indicated by a yes answer at 366, the process checks at 368 if the right-hand boundary of the 3×3 sub-array has been reached. If the answer is no, the relevant indices are updated at 368 and the process returns to 364. When the answer at 368 is yes, this means that the value T is now the sum of the degree-of-fit signals stored in the nine cells of the relevant 3×3 sub-array of the fine map. Using the value of T obtained in the loop from Step 364 through Step 368, the process goes on to Step 370 to find the values of XB and YB as indicated, which are the displacements along the X and Y axis respectively, at which the center of gravity of the nine relevant degree-of-fit signals can be located relative to the central cell of the sub-array of nine cells.

At Step 372 the quantities DIP and AZIMUTH are evaluated based on known geometric relationships as a function of the coordinates of the center of gravity of the degree-of-fit signals contained in the 3×3 part of the fine map (FIG. 12) containing the best degree-of-fit signal found for the fine map. The DIP and AZIMUTH evaluated in Step 372 are those of the assumed bedding surface found by the process to be most likely to correspond to the attitude of a feature of the earth formation at the correlation depth of interest. The DIP and AZIMUTH found at Step 372 may be found in terms of the $d_j$ depth differences discussed above, in terms of the apparent dip and azimuth angles discussed above and/or in terms of the true dip and azimuth angles also discussed above. At Step 374 the process outputs the found dip and azimuth characteristics of the assumed bedding surface of interest and any other characteristics that may be desired, such as the characteristics of the coarse and fine maps discussed above. At Step 376 the process produces a tangible record of the process output, which includes a tangible record of at least the dip and azimuth characteristics of the assumed bedding surface found by the process to be most likely to correspond in attitude to the attitude of a feature of the earth formation at the correlation depth of interest. This tangible record is produced, for example, at the device 70 illustrated in FIG. 1.

The process checks at Step 378 if the best correlation depth of interest has been reached. If the answer is yes, the process ends. If the answer is no, the current value of the correlation depth is updated at Step 380 to point to a new correlation depth of interest (by using a parameter STEP previously provided to the process by a user or provided by the computer system as a default value) and the process returns to Step 300 to proceed as described but in connection with the new correlation depth. In repeating the described process for succeeding correlation depths, the procedure of Step 376 may be carried out such that the relevant process outputs are recorded on the same tangible record to thereby make up a composite tangible record of the relevant characteristics of the earth formation.

I claim:

1. A machine method of exploring a subsurface earth formation comprising the steps of:

producing a respective well log for each of the paths along a borehole in the earth formation which are logged by respective well logging devices carried by a multipad investigating tool moved through the borehole;

producing a set of a dip signal and an azimuth signal for each of a number of assumed bedding surfaces which interest the borehole at a given depth at different attitudes;

for each given one of said assumed bedding surfaces, combining those portions of the logs which have selected relationships to the intersections of the log paths by the given assumed bedding surface to produce an electrical signal related to the mutual degree of fit of the combined log portions; and utilizing said degree-of-fit signals to produce a tangible record of the attitude of an assumed bedding surface which intersects the borehole at the given depth and tends to correspond in attitude to a feature of the earth formation.

2. A machine method as in claim 1 in which the step of combining log portions to produce degree-of-fit signals includes forming a first map having a respective cell for each respective one of the assumed bedding surfaces, said cells being in uniform steps of dip angle and azimuth angle, and storing the dgree-of-fit signal for each respective assumed bedding surface in the cell corresponding to that surface.

3. A machine method as in claim 2 in which the step of combining log portions to produce degree-of-fit signals includes forming a second map having a number of cells which are in uniform steps of differences in borehole depth rather than in uniform steps in dip angle and azimuth angle, each respective cell of the second map corresponding to a respective assumed bedding surface having a respective different attitude, and storing the degree-of-fit signals for the respective assumed bedding surfaces in the respective cells of the second map, the cells of the second map corresponding to a range of attitudes smaller than the range of attitudes corresponding to the cells of the first map, and the range of attitudes for the second map being selected as a function of the degree-of-fit signals stored in the first map.

4. A machine method as in claim 3 in which the utilizing step includes combining the degree-of-fit signals stored in a selected subset of the cells of the second map to find the coordinates, in the second map, of the center of gravity of the degree-of-fit signals stored in said selected subset of the cells of the second map, and using said coordinates to find the attitude of said assumed bedding surface which tends to correspond to a feature of the earth formation.

5. A machine method as in claim 2 in which the utilizing step includes finding the best degree-of-fit signal stored in the map and using the map coordinates of the best degree-of-fit signal to find the attitude of said assumed bedding surface which tends to correspond to a feature of the earth formation.

6. A machine method as in any one of claims 1–5 in which all of the assumed bedding surfaces which intersect the borehole at the given depth intersect each other at a common locus.

7. A machine method as in claim 6 in which the common locus coincides with the centerline of the multipad investigating tool when the tool is at the given depth in the borehole.

8. A machine method as in claim 1 in which the utilizing step comprises producing a tangible record of the attitude of the assumed bedding surface which corresponds to the best one among said degree-of-fit signals.

9. A machine method as in claim 1 in which the utilizing step comprising constructing a coarse map of degree-of-fit signals corresponding to assumed bedding surfaces spaced from each other by relatively large steps in attitude, finding the best degree-of-fit signal in the map, constructing a fine map of degree-of-fit signals corresponding to assumed bedding surfaces spaced from each other in relatively small steps in attitude, wherein the attitudes corresponding to the fine map are within a substantially lesser range of attitudes as compared to those corresponding to the coarse map, and wherein the fine map is substantially centered at the best degree-of-fit signal in the coarse map, and producing said tangible record for the attitude of the assumed bedding surface substantially corresponding to the best degree-of-fit signal in the fine map.

10. A machine method as in claim 1 in which the utilizing step comprises producing a map of the degree-of-fit signals, finding the best degree-of-fit signal therein to thereby find said assumed bedding surface which tends to correspond to a feature of the formation and testing neighboring degree-of-fit signals to thereby determine whether the last recited assumed bedding surface is likely to be planar or nonplanar.

11. A machine method of exploring a subsurface earth formation comprising the steps of:

producing at least three well logs which are for at least three paths along a borehole in the earth formation, which paths are logged by at least three respective well logging devices carried by a multipad investigating tool moved through the borehole;

producing a set of a dip signal and an azimuth signal for each of a number of assumed bedding surfaces which intersect the borehole at a given depth at different attitudes;

for each given one of said assumed bedding surfaces, combining those portions of the at least three well logs which have selected relationships to the intersections of the log paths by the given assumed bedding surface to produce a single electrical signal related to the mutual degree of fit of the combined at least three well log portions; and utilizing said degree-of-fit signals to produce a tangible record of the attitude of an assumed bedding surface which intersects the borehole at the given depth and tends to correspond in attitude to a feature of the earth formation.

12. A machine method as in claim 11 in which the step of combining log portions to produce degree-of-fit signals includes forming a first map having a respective cell for each respective one of the assumed bedding surfaces, said cells being in uniform steps of dip angle and azimuth angle rather than in uniform steps of borehole depth or differences in borehole depth, and storing the degree-of-fit signal for each respective assumed bedding surface in the cell corresponding to that surface.

13. A machine method as in claim 12 in which the step of combining log portions to produce degree-of-fit signals includes forming a second map having cells which are in uniform steps of differences in borehole depth rather than in uniform steps in dip angle and azimuth angle, each respective cell of the second map corresponding to a respective assumed bedding surface having a respective different attitude, and storing the degree-of-fit signals for the respective assumed bedding surfaces in the respective cells of the second map, the cells of the second map corresponding to a range of attitudes smaller than the range of attitudes corresponding to the cells of the first map, and the range of attitudes for the second map being selected as a function of the degree-of-fit signals stored in the first map.

14. A machine method as in claim 13 in which the utilizing step includes combining the degree-of-fit signals stored in a selected subset of the cells of the second map to find the coordinates, in the second map, of the center of gravity of the degree-of-fit signals stored in said selected subset of cells of the second map and using said coordinates to find the attitude of said assumed bedding surface which tends to correspond to a feature of the earth formation.

15. A machine method as in claim 12 in which the utilizing step includes finding the best degree-of-fit signal stored in the cells of the map and using the map coordinates of the best degree-of-fit signal to find the attitude of said assumed bedding surface which tends to correspond to a feature of the earth formation.

16. A machine method as in any one of claims 8–15 in which all of the assumed bedding surfaces which intersect the borehole at the given depth intersect each other at a common locus.

17. A machine method as in claim 16 in which the common locus coincides with the centerline of the multipad investigating tool when the tool is at the given depth in the borehole.

18. A computer-implemented process comprising:

deriving respective well logs for the paths along a borehole in an earth formation which are logged by respective well logging devices carried by a multidevice investigating tool moved through the borehole;

for each of a succession of borehole depths, defining a range of selected attitudes of respective assumed bedding surfaces, and for each attitude deriving a degree-of-fit signal indicative of the similarity between the logs for the places at which the paths thereof in the borehole are intersected by the respective assumed bedding surface;

for each of said borehole depths, finding the attitude of the assumed bedding surface leading to an optimal degree-of-fit signal and producing a tangible record thereof as the attitude tending to correspond to an actual subsurface feature.

19. A computer-implemented process as in claim 18 in which the step of finding the attitude which tends to correspond to an actual subsurface feature comprises building a coarse map of degree-of-fit signals, finding the coordinates therein of a provisionally optimal degree-of-fit signal, building a fine map centered at the last recited coordinates and having a substantially lesser range of attitudes than the coarse map and finding said optimal degree-of-fit signal therein and producing said tangible record based on the coordinates thereof in the fine map.

20. A computer-implemented system comprising:

means for deriving respective well logs for the paths along a borehole in an earth formation which are logged by respective transducers carried by a tool moved through the borehole, said paths being circumferentially spaced from each other in the borehole; and means for producing, for each of a succession of borehole depths, a tangible record of a respective attitude of an assumed bedding surface which tends to correspond to an actual subsurface feature through the process of finding a range of selected attitudes of respective assumed bedding surfaces which intersect each other at each respective one of said depths, deriving for each attitude a degree-of-fit signal indicative of the similarity between the logs for the places at which the paths thereof are intersected by the respective assumed bedding surface and, for each of said borehole depths, finding the attitude of the assumed bedding surface leading to an optimal degree-of-fit signal and producing said tangible record as a record of the attitude of the assumed bedding surface corresponding to said optimal degree-of-fit signal.

21. A computer-implemented system as in claim 20 in which said finding of the attitude of a respective assumed bedding surface leading to an optimal degree-of-fit signal comprises, for each respective borehole depth, building a coarse map of the degree-of-fit signals for the assumed bedding surfaces intersecting each other at a common borehole depth, finding the coordinates therein of a provisionally optimal degree-of-fit signal, building a fine map centered at the last recited coordinates and having a lesser range of attitudes than the coarse map, and finding said optimal degree-of-fit signal in the fine map.

* * * * *